US011913716B2

(12) United States Patent
Gallinelli et al.

(10) Patent No.: US 11,913,716 B2
(45) Date of Patent: Feb. 27, 2024

(54) THERMODYNAMIC SYSTEM CONTAINING A FLUID, AND METHOD FOR REDUCING PRESSURE THEREIN

(71) Applicant: Nuovo Pignone Tecnologie—S.r.l., Florence (IT)

(72) Inventors: Lorenzo Gallinelli, Florence (IT); Marco Pelella, Florence (IT); Fabio Baldanzini, Florence (IT); Leonardo Baldassarre, Florence (IT)

(73) Assignee: Nuovo Pignone Tecnologie—S.R.L., Florence (IT)

( * ) Notice: Subject to any disclaimer, the term of this patent is extended or adjusted under 35 U.S.C. 154(b) by 796 days.

(21) Appl. No.: 16/961,283

(22) PCT Filed: Jan. 11, 2019

(86) PCT No.: PCT/EP2019/050651
§ 371 (c)(1),
(2) Date: Jul. 10, 2020

(87) PCT Pub. No.: WO2019/138049
PCT Pub. Date: Jul. 18, 2019

(65) Prior Publication Data

US 2021/0063082 A1 Mar. 4, 2021

(30) Foreign Application Priority Data

Jan. 12, 2018 (IT) ..... 102018000000808
Aug. 30, 2018 (IT) ..... 102018000008260

(51) Int. Cl.
*F25B 9/00* (2006.01)
*F25J 1/00* (2006.01)
*F25J 1/02* (2006.01)

(52) U.S. Cl.
CPC ..... *F25J 1/0022* (2013.01); *F25B 9/006* (2013.01); *F25J 1/0052* (2013.01); *F25J 1/0087* (2013.01);
(Continued)

(58) Field of Classification Search
CPC ..... F25B 9/006; F25B 2500/27; F25J 1/0207; F25J 1/0022; F25J 1/0217; F25J 1/0268;
(Continued)

(56) References Cited

U.S. PATENT DOCUMENTS 3,733,838 A 5/1973 Delahunty
5,321,944 A * 6/1994 Bronicki ..... F04D 29/5826 60/775
(Continued)

FOREIGN PATENT DOCUMENTS

WO 2008139528 A1 11/2008
WO 2017/005842 A1 1/2017

OTHER PUBLICATIONS

International Search Report of the International Searching Authority for PCT/EP2019/050651 dated Apr. 9, 2019.

*Primary Examiner* — Brian M King
(74) *Attorney, Agent, or Firm* — Paul Frank + Collins P.C.

(57) ABSTRACT

A thermodynamic system containing a working fluid is disclosed. The thermodynamic system comprises at least a working fluid collection vessel (11) adapted to contain a liquid phase and a gaseous phase of the working fluid in thermodynamic equilibrium. A chilling arrangement (51) is functionally coupled to the fluid collection vessel (11) and adapted to remove heat from the working fluid collected in the working fluid collection vessel (11) and thereby reduce pressure in said thermodynamic system. Also disclosed are
(Continued)

methods for depressurizing a thermodynamic system containing a working fluid in liquid/gas equilibrium.

19 Claims, 23 Drawing Sheets

(52) U.S. Cl.
CPC ..... *F25J 1/0247* (2013.01); *F25J 1/0298* (2013.01); *F25J 2280/10* (2013.01); *F25J 2290/62* (2013.01)

(58) Field of Classification Search
CPC ..... F25J 1/0279; F25J 1/0045; F25J 1/0052; F25J 2280/10; F25J 2290/62; F25J 2235/60; F25J 2290/34
See application file for complete search history.

(56) References Cited

U.S. PATENT DOCUMENTS

| | | | | |
|---|---|---|---|---|
| 2005/0160750 | A1 | 7/2005 | Shaffer et al. | |
| 2006/0021378 | A1* | 2/2006 | Schmidt | F25J 1/0022 62/612 |
| 2013/0129471 | A1 | 5/2013 | Gupta | |
| 2015/0184930 | A1* | 7/2015 | Bonnissel | F25J 1/0214 62/611 |
| 2017/0089637 | A1* | 3/2017 | Wehrman | F25J 1/0294 |
| 2017/0131026 | A1* | 5/2017 | Imamkhan | F25J 1/0292 |
| 2018/0223856 | A1 | 8/2018 | Gallinelli et al. | |
| 2019/0195555 | A1* | 6/2019 | Van De Rijt | F25J 1/0252 |

* cited by examiner

THERMODYNAMIC SYSTEM CONTAINING A FLUID, AND METHOD FOR REDUCING PRESSURE THEREIN

TECHNICAL FIELD

The present disclosure concerns thermodynamic systems and methods. Embodiments disclosed herein specifically concern thermodynamic systems comprising a closed circuit wherein a working fluid is processed and undergoes cyclic thermodynamic transformations, including compression, cooling, condensation, expansion and vaporization. Also disclosed herein are methods for reducing the settle-out pressure (SOP) of a closed circuit in a thermodynamic system following shutdown of a pressure boosting apparatus, such as a compressor, to facilitate startup of the system.

BACKGROUND ART

In thermodynamic systems, where a working fluid is processed in a closed circuit and undergoes thermodynamic transformations comprising phase transitions between a liquid state and a gaseous state, shutdown of the compressor or other pressure boosting facility, causes pressure equalization in the closed circuit, until a so-called settle-out pressure is achieved. The settle-out pressure depends, among others, upon the temperature of the circuit.

Settle-out pressure can dramatically increase and reach values well above the design conditions, thus adversely affecting the startup capability of the compressor driver. This is particularly the case where the thermodynamic system comprises a refrigeration circuit and is arranged in a hot environment. When the thermodynamic system is shut down and remains inoperative for a relatively long time at high ambient temperature, the thermodynamic system starts heating up. The liquid accumulated in the closed compression loop begins to vaporize and pressurize the closed circuit, until the equilibrium pressure at ambient temperature or at the temperature of the metallic structure defining the closed circuit is achieved. This temperature may be as high as 50° C. or higher, due to solar irradiation, for instance. The resulting settle-out pressure may be well above the design point and may be such that the compressor driver is incapable of starting up the compressor again.

In order to re-start circulation in the thermodynamic system, a recovery compressor is sometimes used, which transfers gas in the condenser and the resulting condensed and liquefied working fluid is transferred in a liquid collection vessel, thus reducing the pressure in the closed circuit until sufficient a low pressure is achieved for the compressor driver to start up the compressor again.

In other embodiments of the current art, venting of the circuit is required to remove gas therefrom and reduce the pressure. Vented gas is burned in a flare.

Both approaches negatively affect the operation costs of the system and may have an adverse environmental impact.

Generally speaking, similar issues may arise in thermodynamic systems comprising a pressurized circuit adapted to contain a working fluid and comprising at least one working fluid collection vessel, adapted to contain at least two phases of a working fluid, specifically a liquid phase and a gaseous phase in a condition of thermodynamic equilibrium. Since the equilibrium pressure in a bi-phase system depends upon the temperature of the fluid, when the temperature increases, the equilibrium pressure in the system increases as well and may become higher than a threshold pressure. This may prejudice or adversely affect one or more functionalities of the system or prevent operation thereof altogether. If this situation occurs, venting the thermodynamic system is required or a dedicated compressor is needed to circulate the fluid in a condenser, to lower the pressure therein. Venting may cause loss of valuable products, cause environmental pollution or entail other disadvantages.

Accordingly, an improved system and method for startup of a thermodynamic system to address the issues of complexity and fluid waste of the systems of the current art would be beneficial and would be welcomed in the technology. More in general, it would be desirable to provide methods and systems adapted to more efficiently address problems entailed by increasing temperatures and equilibrium pressure in a thermodynamic system comprising a fluid collection vessel containing a working fluid in liquid-gas equilibrium conditions.

SUMMARY

In one aspect, the subject matter disclosed herein is directed to a thermodynamic system containing a working fluid and comprising at least a fluid collection vessel adapted to contain a liquid phase and a gaseous phase of the working fluid in thermodynamic equilibrium. As understood herein, the term gaseous phase may include a vapor phase of the working fluid. A chilling arrangement is functionally coupled to the fluid collection vessel and adapted to remove heat from the working fluid contained in the fluid collection vessel and thereby reduce pressure in the thermodynamic system. The internal fluid pressure of the thermodynamic system can thus be dropped without venting working fluid or resorting to other complex measures.

In another aspect, the subject matter disclosed herein concerns a method for reducing a fluid pressure in a thermodynamic system containing a working fluid and comprising at least a fluid collection vessel, adapted to contain liquefied working fluid and gaseous working fluid in thermodynamic equilibrium. In embodiments disclosed herein, the method includes a step of removing heat from the fluid contained in the fluid collection vessel. The method further includes condensing gaseous working fluid into liquefied working fluid thus reducing said fluid pressure in the thermodynamic system. The steps can be at least partly simultaneous, in that condensing gaseous working fluid can involve simultaneous heat removal.

In another aspect, disclosed herein is a method for reducing a fluid pressure in a thermodynamic system comprising a closed circuit containing a working fluid therein and having at least a high-pressure section, a low-pressure section, and a pressure boosting arrangement between them, the closed circuit comprising at least one fluid collection vessel adapted to contain liquefied working fluid and gaseous working fluid in thermodynamic equilibrium. The method includes the following steps:

- removing heat from the working fluid contained in fluid collection vessel while the pressure boosting arrangement is in a non-operating condition;
- condensing a portion of the working fluid from a gaseous phase into a liquid phase in said fluid collection vessel, thus reducing pressure in the closed circuit; and
- upon reaching a startup pressure threshold in at least a section of the closed circuit, starting operation of the pressure boosting arrangement.

A further aspect of the present disclosure is drawn to a thermodynamic system including a closed circuit adapted to circulate a working fluid therein and including at least a high-pressure section and a low-pressure section. The circuit further includes a pressure boosting arrangement between the high-pressure section and the low-pressure section and a heat removal and fluid condensing arrangement adapted to receive compressed working fluid and at least partly condense said compressed working fluid by removing heat therefrom. The closed circuit further includes at least one working fluid collection vessel adapted to contain liquefied working fluid and gaseous working fluid in thermodynamic equilibrium. A chilling arrangement is functionally coupled to the working fluid collection vessel and adapted to remove heat from the working fluid contained therein or intended to be collected therein, thereby reduce pressure in said thermodynamic system.

Furthermore, disclosed herein is a method for reducing a fluid pressure in a thermodynamic system including a closed circuit containing a working fluid therein and having: a high-pressure section; a low-pressure section; a pressure boosting arrangement between the high-pressure section and the low-pressure section; at least one working fluid collection vessel adapted to contain liquefied working fluid and gaseous working fluid in thermodynamic equilibrium; the method comprising the following steps:

removing heat from the working fluid while the pressure boosting arrangement is in a non-operating condition;

condensing a portion of the working fluid from a gaseous phase into a liquid phase, thus reducing pressure in the closed circuit; and upon reaching a startup pressure threshold in at least a section of the closed circuit, starting operation of the pressure boosting arrangement.

According to some embodiments the step of condensing the working fluid from a gaseous phase into a liquid phase comprises the step of drawing working fluid in a gaseous phase from the working fluid collection vessel.

The subject matter disclosed herein also concerns a thermodynamic system comprising:

a closed refrigeration circuit adapted to circulate a working fluid therein, comprised of a heat exchange arrangement adapted to circulate cold expanded working fluid in heat exchange relationship with a process fluid and remove heat therefrom;

a pressurized working fluid collection vessel, fluidly directly or indirectly coupled to the refrigeration circuit and adapted to collect said working fluid; and a liquefied process fluid storage unit, adapted to collect liquefied process fluid therein;

wherein a chilling arrangement is functionally coupled to said working fluid collection vessel and adapted to remove heat from the working fluid collected therein by heat exchange with process fluid from the liquefied process fluid storage unit.

Heat can be removed by circulating working fluid from the working fluid collection vessel through the chilling arrangement and back to the working fluid collection vessel. In other embodiments, heat can be removed from the working fluid before collecting the working fluid in the collection vessel.

In some embodiments, the process fluid can be natural gas and the closed refrigeration circuit can be a refrigeration circuit of a natural gas liquefaction plant or system, which may include one or more refrigeration circuits.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
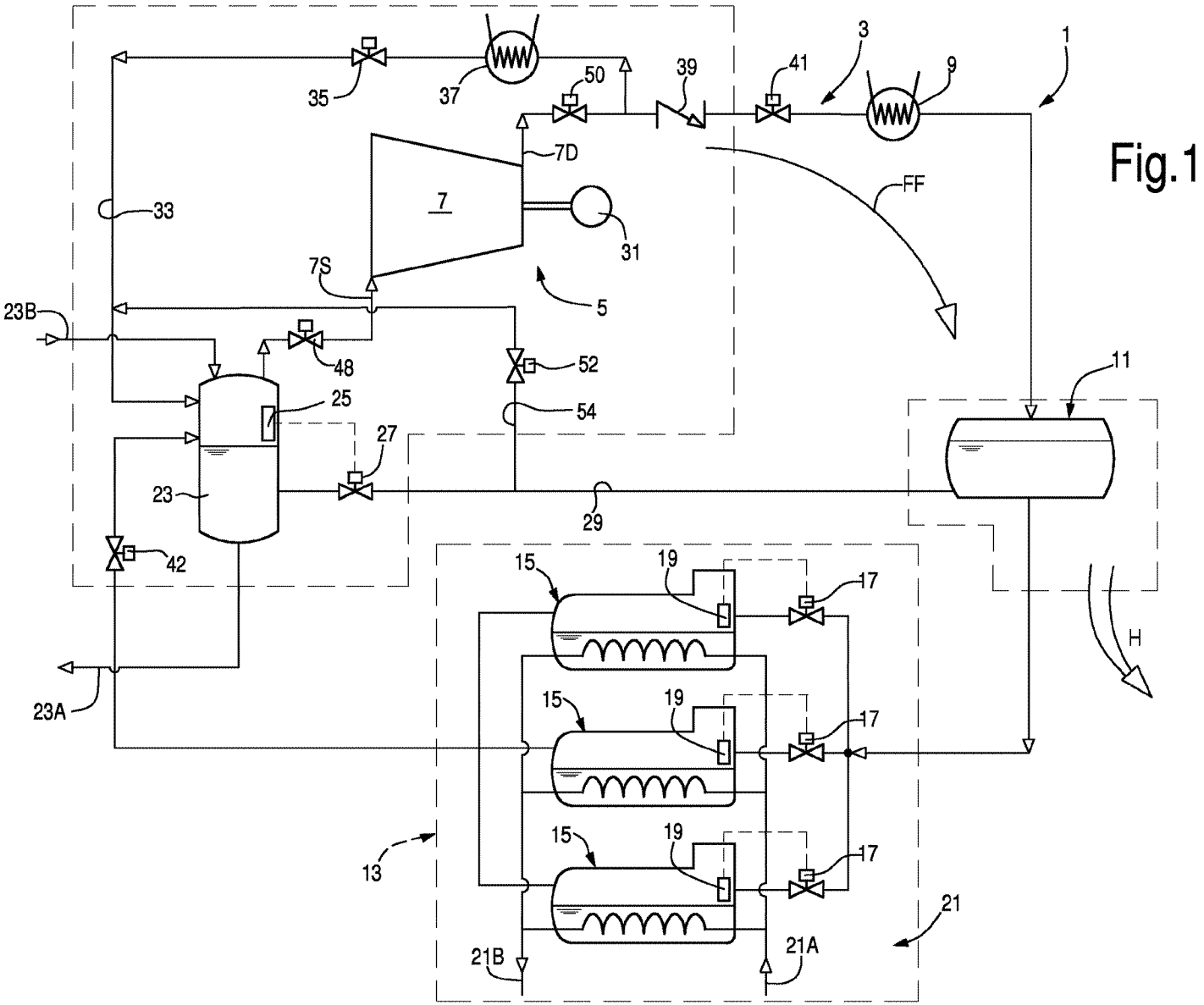
FIG. 1 illustrates a schematic of a thermodynamic system including a closed circuit and a compression facility.

According to one aspect, the present subject matter is directed to systems and methods for facilitating the startup of a thermodynamic system following tripping of a compressor or other pressure boosting arrangement, as a consequence of which the settle-out pressure (SOP) inside the thermodynamic system has increased. Specifically, in several embodiments disclosed herein a thermodynamic system is provided, which includes a closed circuit adapted to circulate a working fluid, which undergoes cyclic thermodynamic transformations. In operation, a compressor, or any other pressure boosting arrangement provided in or along the closed circuit, boosts the pressure of the working fluid and circulates the working fluid in the closed circuit. The closed circuit comprises several sections, such as a low-pressure section and a high-pressure section. The pressure boosting arrangement sucks working fluid from the low-pressure section and pumps the working fluid in the high-pressure section. The thermodynamic system can further comprise at least one heat removal and fluid condensing arrangement, wherein compressed working fluid is cooled and at least partly condensed. The thermodynamic system further comprises at least one fluid collection vessel, adapted to collect working fluid in a liquid/gas equilibrium condition, i.e. containing working fluid in a bi-phase state, partly in a liquid state and partly in a gaseous or vapor state.

When the pressure boosting arrangement is shut down, e.g. the compressor which delivers the working fluid in the high-pressure section of the closed circuit trips, the entire closed circuit starts heating as a consequence of environmental temperature. Since the circuit contains two-phase working fluid in at least one portion thereof, the liquid phase will start evaporating, thus increasing the pressure inside the whole closed circuit until a settle-out pressure is achieved, which depends upon the actual temperature inside the closed circuit.

To facilitate re-starting of the thermodynamic system without resorting to fluid venting and flaring, the working fluid contained in the at least one fluid collection vessel mentioned above is cooled, thus reducing the temperature inside the closed circuit and at least partly condensing the gaseous working fluid present in the circuit into liquefied working fluid. The pressure in the closed circuit is thus gradually reduced, until a pressure value suitable for startup of the thermodynamic system is achieved. This pressure value is the equilibrium pressure of the liquid-gas bi-phase system in the fluid collection vessel at the temperature achieved by the working fluid therein.

Startup of the pressure boosting arrangement can thus be performed without requiring an over-dimensioned driver for the pressure boosting arrangement and without wasting high-value working fluid contained in the closed circuit.

According to a more general aspect, the subject matter disclosed herein is directed to systems and methods for reducing the equilibrium pressure in a bi-phase system containing a liquid phase and a gaseous phase of a working fluid, for instance in a fluid collection vessel forming part of a thermodynamic system. The equilibrium pressure may have increased following heating up of the bi-phase system; reduction of the equilibrium pressure may be required for several reasons, for instance to re-start circulation of the working fluid in a closed circuit, or to avoid disruption of the system. Embodiments disclosed herein provide for a chilling arrangement, which removes heat from the bi-phase system and thus reduces the equilibrium pressure of the bi-phase system.

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

When introducing elements of various embodiments the articles "a", "an", "the", and "said" are intended to mean that there are one or more of the elements. The terms "comprising", "including", and "having" are intended to be inclusive and mean that there may be additional elements other than the listed elements.

Referring now to the drawings, FIG. 1 shows a schematic of an exemplary thermodynamic system 1. The thermodynamic system 1 can be comprised of a closed circuit 3, wherein a working fluid is adapted to circulate and to undergo cyclic thermodynamic transformations, including compression, condensation, cooling and expansion. Circulation of the working fluid in the closed circuit 3 is performed by means of a pressure boosting arrangement 5. As used herein, the term "pressure boosting arrangement" is expressly defined to include any machine or system, in which working fluid is delivered at a first, suction pressure and from which working fluid is delivered at a second, delivery pressure, the delivery pressure being higher than the suction pressure. In the exemplary embodiment shown in FIG. 1 the pressure boosting arrangement 5 comprises a compressor 7 having a suction side 7S and a delivery side 7D.

Downstream of the pressure boosting arrangement 5, with respect to the direction of the working fluid flow schematically represented by arrow FF, a heat removal and fluid condensing arrangement 9 is provided. As used herein, the term "heat removal and fluid condensing arrangement" is expressly defined as any facility, system or arrangement capable of removing heat from the working fluid circulating therein and at least partly condensing working fluid from a gaseous state to a liquid state. Thus, the heat removal and fluid condensing arrangement 9 can include a heat exchanger, for instance a liquid/air or liquid/liquid heat exchanger. In other embodiments, the heat removal and fluid condensing arrangement 9 can include any other kind of heat removal arrangement or device. The heat removal and fluid condensing arrangement 9 can also be part of multi-stream heat exchangers, such as for instance finned plates, or wound coil heat exchangers.

A condensate collecting vessel 11 is arranged downstream of the heat removal and fluid condensing arrangement 9. The portion of the closed circuit 3 between the delivery side 7D of the compressor 7 and the condensate collecting vessel 11 forms a first, high-pressure section of closed circuit 3. A portion of the closed circuit 3 downstream of an expansion valve 17 or 27 or 52, or downstream of an evaporator, to be disclosed later, up to the suction side 7S of the compressor 7 forms a second, low-pressure section of closed circuit 3.

In some embodiments, the second, low-pressure section of the closed circuit 3 can comprise an evaporation section 13. In some embodiments, the evaporation section 13 can include one or more evaporators 15, which are fluidly coupled to the condensate collecting vessel 11 and further fluidly coupled to the pressure boosting arrangement 5, e.g. with the suction side 7D of compressor 7. In some embodiments, as shown in FIG. 1, the evaporators 15 can be arranged in parallel. In other embodiments, the evaporators can be part of multi-stream heat exchangers, such as for instance finned plates or wound coil heat exchangers.

In some embodiments, between each evaporator 15 and the condensate collecting vessel 11 a respective pressure reduction valve 17 is arranged. The first, high-pressure section of the closed circuit extends up to the pressure reduction valves 17.

Each pressure reduction valve 17 can be controlled by a respective level control device 19, which selectively opens and closes the pressure reduction valve 17 to maintain a desired level of liquefied working fluid inside the respective evaporator 15. Working fluid from the condensate collecting vessel 11 is thus delivered, at a lower pressure, into each evaporator 15 upon request by the level control device 19 by opening the respective pressure reduction valve 17.

The evaporation section 13 can be used to chill a flow of process fluid which circulates in a process fluid circuit 21, having a fluid inlet 21A and a fluid outlet 21B. Hot process fluid enters the evaporation section 13 at the fluid inlet 21A at a first temperature and exits the evaporation section 13 at the fluid outlet 21B at a second temperature, lower than the first temperature. The process fluid is cooled by means of latent heat absorbed by the working fluid in the evaporators 15. The working fluid in the evaporators 15 thus gradually evaporates and the gaseous working fluid thus produced is delivered to the pressure boosting arrangement 5. A sufficient amount of liquefied working fluid in boiling conditions is maintained in the evaporators by selectively opening pressure reduction valves 17 under the control of the level control devices 19.

In some embodiments, a suction drum 23 can be arranged in the second, low-pressure section of the closed circuit 3, between the evaporation section 13 and the suction side of the pressure boosting arrangement 5. The suction drum 23 can contain working fluid stored therein, in a condition of thermodynamic equilibrium in a two-phase condition, with the working fluid partly in gaseous state and partly in liquefied state. In some embodiments a level control device 25 can be provided, to maintain the liquid level in the suction drum 23 at a desired value. The level control device 25 can be functionally coupled to a level control valve 27 arranged along a connection line 29, which fluidly couples the suction drum 23 to the condensate collecting vessel 11. Working fluid in the gaseous phase is sucked by the pressure boosting arrangement 5, compressed and delivered to the heat removal and fluid condensing arrangement 9. If the liquid level in the suction drum 23 drops below a minimum threshold, the level control device 25 opens the level control valve 27, such that the liquid level in the suction drum 23 is restored by liquefied working fluid from the condensate collecting vessel 11.

In some embodiments the suction drum 23 can be fluidly coupled to a low pressure evaporator, not shown, through a liquid delivery line 23A and a vapor return line 23B. In some embodiments the anti-surge line 33 can end under the liquid level inside the suction drum 23, for instance if no heat exchanger is available along the recycling, anti-surge flow path.

While in the schematic of FIG. 1 described so far the closed circuit 3 comprises a pressure boosting arrangement 5 which includes a simple compressor 7, in other embodiments, a more complex thermodynamic system 1 can be provided, wherein the low-pressure section of the closed circuit 3 comprises a larger number of apparatuses and a more complex aggregate of machinery, through which the working fluid is processed and undergoes any kind of single phase or multi-phase process. What matters, for the purpose of the understanding of the present disclosure, is that between the low-pressure section and the high-pressure section of the thermodynamic system, the pressure of the working fluid is increased by means of energy delivered thereto, e.g. in form of mechanical energy used to drive a compressor.

In the schematic of FIG. 1 a driver 31 is shown, which drives the compressor 7 in rotation by providing the required mechanical power. The driver 31 can be an electric motor. In other embodiments the driver 31 can be a mechanical power-generating turbomachine, such as a gas turbine engine or a steam turbine. In yet further embodiments, the driver 31 can include a reciprocating, internal combustion engine.

Moreover, in FIG. 1 an evaporation section 13 is inserted in the low-pressure section of the closed circuit 3 of the thermodynamic system 1, it being understood that this is just provided as an exemplary embodiment. As a matter of fact, the thermodynamic system 1 can comprise different arrangements of devices and machines.

In some embodiments, the compressor 7 can be an axial compressor or a centrifugal compressor, such as a single-stage or a multi-stage axial or centrifugal compressor, an integrally geared compressor, or a compressor train.

In some embodiments, the delivery side 7D of the compressor 7 is fluidly coupled to the suction side 7S thereof by an anti-surge line 33. An anti-surge valve 35 can be arranged along the anti-surge line 33. The anti-surge valve 35 is selectively opened to prevent surging phenomena in the compressor 7. For instance, the anti-surge valve 35 may be opened when the thermodynamic system 1 is started after a period of non-operation. The anti-surge valve 35 may also be opened during operation of the compressor 7, if the operating point of the compressor approaches a surge limit line.

Cooling arrangements can be provided, to cool the working fluid delivered at the delivery side of the compressor 7 prior to suction at the suction side thereof, thus preventing over-heating of the working fluid when the anti-surge line 33 is open.

For the purpose of cooling the recirculating working fluid, according to some embodiments a cooler 37 can be provided between the delivery side 7D of compressor 7 and the suction drum 23, preferably between the delivery side 7D and the anti-surge valve 35. Gas circulating in the anti-surge line 33 can be chilled in the cooler 37 prior to entering the suction drum 23, and preferably upstream of the anti-surge valve 35.

In combination to, or instead of the cooler 37, a quench valve 52 or another spraying device can be provided along a line 54 and fluidly coupled to the condensate collecting vessel 11 and to the anti-surge line 33. The line 54 can be connected to the anti-surge line 33, between the anti-surge valve 37 and the suction drum 23. Condensed working fluid expanded in the quench valve 52 can thus be delivered from the condensate collecting vessel 11 to the anti-surge line 33, to reduce the temperature of the gas circulating in the anti-surge line 33.

In yet further embodiments, the free end of the anti-surge line 33 can be located under the liquid level in the suction drum 23, in order to cool down the hot recycled gaseous working fluid by heat exchange against the accumulated liquid. In this case chilling arrangements along the anti-surge line 33 can be dispensed with.

Between the pressure boosting arrangement 5 and the heat removal and fluid condensing arrangement 9 a check valve 39 can be provided. According to some embodiments, an isolation valve 41 can also be provided between the pressure boosting arrangement 5 and the heat removal and fluid condensing arrangement 9. A further isolation valve 42 can be arranged between the evaporation section 13 and the suction drum 23. Closure of the isolation valves 41 and 42 will isolate the pressure boosting arrangement 5 from the circuit 3.

In some embodiments, a first compressor isolation valve 48 and a second compressor isolation valve 50 can be arranged at the suction side 7S and at the delivery side 7D of compressor 7, to isolate the compressor 7 from the remaining circuit 3 and depressurize the compressor 7, if required.

Thermodynamic system 1 operates as follows. Working fluid is continuously circulated in the closed circuit 3 by the pressure boosting arrangement 5, using mechanical power generated by the driver 31. Compressed working fluid in the gaseous state is delivered to the heat removal and fluid condensing arrangement 9. As used herein the term "gaseous" is expressly defined as also encompassing fluid in vapor state. Heat is removed from the gaseous working fluid flowing there through and the working fluid is thus at least partly condensed and collected in the condensate collecting vessel 11.

Condensed working fluid is then delivered through pressure reduction valves 17 to the evaporators 15. The low-pressure working fluid in the evaporators 15 boils at relatively low temperature absorbing latent vaporization heat from the process fluid circulating in the process fluid circuit 21, which is thus cooled. Working fluid in the gaseous state is delivered through the suction drum 23 to the pressure boosting arrangement 5, compressed and delivered again to the heat removal and fluid condensing arrangement.

Under normal operating conditions, therefore, working fluid in the liquid state and working fluid in the gaseous state are present in a condition of thermodynamic equilibrium in several sections of the thermodynamic circuit, and in particular at least in the condensate collecting vessel 11 and possibly in the suction drum 23.

When the thermodynamic system 1 is shut down, the working fluid in the closed circuit 3 starts vaporizing and pressurizes the closed circuit 3, until a settle-out pressure is achieved. This pressure depends upon the temperature achieved by the thermodynamic system that may be as high as 50° C., for instance 60° C. or even higher, if the closed circuit 3 is exposed to solar radiation, for instance. The resulting settle-out pressure can be so high that the pressure boosting arrangement 5 can be unable to re-start the system.

According to the present disclosure, in order to avoid resorting to venting the closed circuit 3 or to other complex and inefficient measures, the working fluid pressure is reduced by removing heat H from the closed circuit 3 and thus causing condensation of the vaporized working fluid contained therein. In FIG. 1 this is schematically represented by arrow H, which pictorially represents heat removal from the working fluid contained in the condensate collecting vessel 11.

In general, heat can be removed from any portion, part, element or section of the thermodynamic system 1, in which working fluid in both liquid state and gaseous state is present in a condition of thermodynamic equilibrium. Instead of removing heat from the condensate collecting vessel 11, heat can be removed from the suction drum 23, for instance. In general, heat can be removed from any fluid collection vessel provided in the closed circuit or fluidly coupled therewith and in which a bi-phase working fluid is collected.

As used herein, a fluid collection vessel can thus be understood as any vessel, container or apparatus, which is adapted to contain working fluid in two phases, namely liquid and gaseous, in a thermodynamic equilibrium.

In general, at least one chilling arrangement for removing heat and condensing gas in the closed circuit 3 can be functionally coupled to at least one fluid collection vessel for removing heat, condensing working fluid and thus reducing the pressure in the closed circuit 3 from the settle-out pressure to a lower pressure level, at which the thermodynamic system 1 can be started again.

As used herein, the term "chilling arrangement" is expressly defined as any device, system, machinery or aggregate which is adapted to remove heat from the fluid collection vessel to condensate gaseous working fluid and reduce the internal pressure of the closed circuit 3.

Several embodiments of possible chilling arrangements will be described below with reference to the following FIGS. 2, 3, 4, 5, 6, 7, 8, 9 and 10. Some of these chilling arrangements are described in functional relationship with the condensate collecting vessel 11. At least some of said chilling arrangements could well be functionally coupled to another fluid collection vessel of the thermodynamic system, for instance the suction drum 23. In more general terms, while in FIGS. 2, 3, 4, 5, 6, 7, 8, 9 and 10 reference will be made to a "fluid collection vessel" identified as the condensate collecting vessel 11 of FIG. 1, it shall be understood that such fluid collection vessel could be another portion or component of the thermodynamic system 1, adapted to collect liquid and gaseous working fluid in a condition of thermodynamic equilibrium.

In some embodiments, the chilling arrangement requires a source of cooling fluid. This source of cooling fluid can be provided by another process of a more complex plant, whereof the thermodynamic system 1 forms part. In other embodiments, a dedicated refrigeration cycle can be provided, which is dedicated to startup of the thermodynamic system 1 by reducing pressure inside the closed circuit 3 when required.

Figure 2:
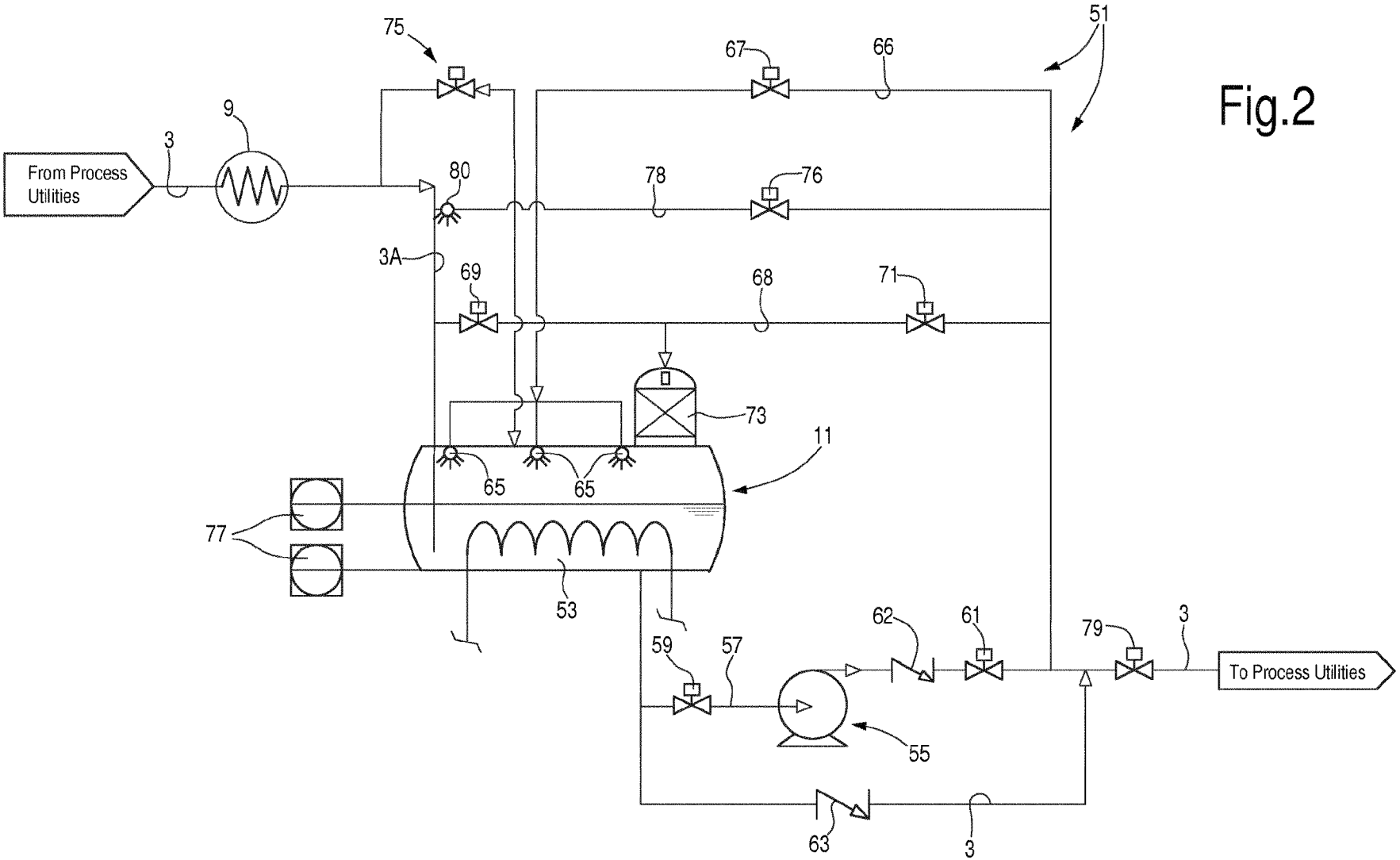
FIG. 2 illustrates a working fluid accumulation vessel and a chilling arrangement combined therewith, according to a first embodiment.

With continuing reference to FIG. 1, FIG. 2 illustrates an embodiment of a chilling arrangement 51 for removing heat from the working fluid contained in the closed circuit 3 of a thermodynamic system 1. In the embodiment of FIG. 2 the chilling arrangement 51 comprises a first heat removal device adapted to remove heat from the liquefied working fluid contained in the fluid collection vessel 11. The first heat removal device can comprise a heat exchanger 53 arranged in the fluid collection vessel forming part of the closed circuit 3 or fluidly coupled thereto. In some embodiments, the fluid collection vessel can be the condensate collecting vessel 11 of the thermodynamic system 1 of FIG. 1. In FIG. 2 and in the following figures, therefore, the fluid collection vessel will be labeled 11. It shall however be noted that in some embodiments the thermodynamic system may include a condensate collecting vessel and a separate fluid collection vessel, which can be fluidly coupled to one another. Such configuration will be described later on with reference to some exemplary embodiments.

A refrigerant is caused to circulate in the heat exchanger 53. For instance, the refrigerant may comprise a fluid selected from the group comprising: methane, nitrogen, mixed refrigerant, ethane, ethylene, propylene, ammonia, butane, or mixtures thereof. While the above mentioned fluids are indicated by way of example, it shall be understood that other refrigerants can be used, depending upon the operating conditions of the thermodynamic system 1. The refrigerant may be delivered by an ad hoc refrigeration circuit, or may be provided by another process present in the plant in which the thermodynamic system 1 is arranged.

The temperature of the refrigerant circulating in the heat exchanger 53 is lower than the temperature of the liquefied working fluid contained in the fluid collection vessel. The heat exchanger 53 can comprise for example a tube bundle, one or more coils, one or more finned plates, or combinations thereof, which can be partly or entirely submerged in the liquefied working fluid contained in the fluid collection vessel 11.

The chilling arrangement 51 can further comprise a first circulation pump 55 adapted to circulate liquefied working fluid. The circulation pump 55 can be arranged on a by-pass line in parallel to a portion of the closed circuit 3. For example, the circulation pump 55 can be arranged in a by-pass line 57, between a first control or isolation valve 59 and a second control or isolation valve 61. A check valve 63 can be arranged on closed circuit 3 in parallel to the circulation pump 55. A further check valve 62 can be arranged on by-pass line 57, between the circulation pump 55 and the second control or isolation valve 61.

In some embodiments, the circulation pump 55 is fluidly coupled to at least one quench valve or spray nozzle 65, or another spraying device, arranged in the upper part of the fluid collection vessel 11. The circulation pump 55 can be fluidly coupled to the quench valves 65 through a line 66, along which a control or isolation valve 67 can be arranged. In parallel to the control or isolation valve 67 a bypass line 68 is arranged, adapted to selectively connect the delivery side of the circulation pump 55 to a fluid delivery duct 3A forming part of the closed circuit 3 and fluidly coupling the fluid collection vessel 11 to the upstream portion of the closed circuit 3, for instance to the fluid condensing arrangement 9. The open end of the fluid delivery duct 3A can be under the level of liquefied working fluid contained in the fluid collection vessel 11. In some embodiments, shut-off valves 69, 71 are arranged along bypass line 68. Between valves 69, 71 the bypass line 68 is fluidly connected to a non-condensable fluids removing device 73, adapted to remove non-condensable fluids from the fluid collection vessel 11.

The quench valves 65 or other spraying devices can be configured to spray small droplets of liquefied working fluid in the gaseous working fluid contained in the fluid collection vessel 11. Cooling is thus obtained by sensible heat transfer and by latent heat transfer, as the droplets are caused to vaporize absorbing latent heat from the gaseous working fluid.

During normal operation of the thermodynamic system 1, the shut-off valve 69 is open while the shut-off valve 71 is closed. During a cooling phase, when heat is removed from the fluid collection vessel 11 by the chilling arrangement 51, the valve 69 is closed while the valve 71 is open.

In some embodiments, not shown, a dedicated vent valve can be provided, instead of a non-condensable fluids removing device 73.

In some embodiments, in particular if the open end of the fluid delivery duct 3A is under the level of the liquefied fluid in the fluid collection vessel 11, the chilling arrangement 51 can be provided further with a siphon breaker 75, adapted to prevent liquefied working fluid from entering duct 3A, or to discharge liquefied working fluid from the fluid delivery duct 3A, such that the liquid level in the fluid delivery duct 3A is the same as in the fluid collection vessel 11.

In some embodiments, the chilling arrangement 51 can further comprise a temperature control system 77 adapted to detect the temperature of the liquefied working fluid contained in the fluid collection vessel 11. In some embodiments, as schematically shown in FIG. 2, the temperature control system 77 comprises multiple temperature sensors, for instance a first temperature sensor at the bottom of the fluid collection vessel 11 and a second temperature sensor near the upper level of the liquefied working fluid, such that a temperature profile along the depth of the liquefied working fluid can be detected. This information can be particularly useful during fluid cooling and pressure reduction.

According to some embodiments, a backup connection line 78 can be provided to connect the delivery side of the pump 55 to the fluid delivery duct 3A. An isolation valve 76 can be provided along the backup connection line 78 to selectively close or open the backup line 78. A quench valve or spray nozzle 80 can be further provided, whereto liquefied working fluid can be delivered by pump 55 through the backup line 78 when the isolation valve 76 is open, and by means of which chilled liquefied working fluid can be sprayed in the fluid delivery duct 3A.

The quench valve 80 along backup line 78 can be used as an alternative to valve 68 or in combination therewith. In this way liquid can be sprayed in delivery duct 3A.

In general, a layout using a quench valve or spray nozzle 80 as described above can be used also alone or in combination with other cooling arrangements according to various embodiments disclosed herein.

The backup connection line 78 and relevant quench valve 80 can be particularly useful as backup chilling facilities in case of failure of quench valves 65, for instance. Prior to activating the backup line 78, liquefied working fluid shall be discharged from the fluid delivery duct 3A, e.g. by opening the siphon breaker 75.

With the chilling arrangement 51 of FIG. 2 the following steps can be performed to reduce pressure in the thermodynamic system 1 prior to starting up the thermodynamic system after shutdown, once the pressure inside the closed circuit 3 has reached a settle-out pressure.

As a first step, refrigerant can start flowing through the heat exchanger 53. Once the temperature of the liquefied working fluid contained in the fluid collection vessel 11 has been reduced, i.e. the liquefied working fluid has been sub-cooled, the circulation pump 55 can be switched on. An isolation control valve 79 arranged along the closed circuit 3 downstream of the circulation pump 55 and downstream of control valve 61 has been previously closed, e.g. when the pressure boosting arrangement 5 has been shutoff. Thus, when the pump 55 is started, no fluid is pumped towards the low-pressure section of the closed circuit 3. The control valves 59, 61, 67 can be open, such that pressurized liquefied working fluid is pumped towards the quench valves 65 and is sprayed into the fluid collection vessel 11 at low pressure. The low-pressure working fluid thus sprayed in the fluid collection vessel 11 chills the gaseous working fluid contained in the fluid collection vessel 11 and promotes condensation, thus reducing the pressure in the fluid collection vessel 11.

If a non-condensable fluids removing device 73 is provided, valve 71 can be opened and valve 69 can be closed, such that chilled liquefied working fluid from the fluid collection vessel 11 is pumped by pump 55 also through device 73.

While the above described process continues, the amount of liquefied working fluid in the fluid collection vessel 11 increases and the total amount of gaseous working fluid in the closed circuit 3 drops, thus leading to an overall reduction of pressure in the closed circuit 3. The chilling process can be interrupted when a lower pressure threshold in the closed circuit 3 is achieved, at which the pressure boosting arrangement 5 can be started.

Figure 3:
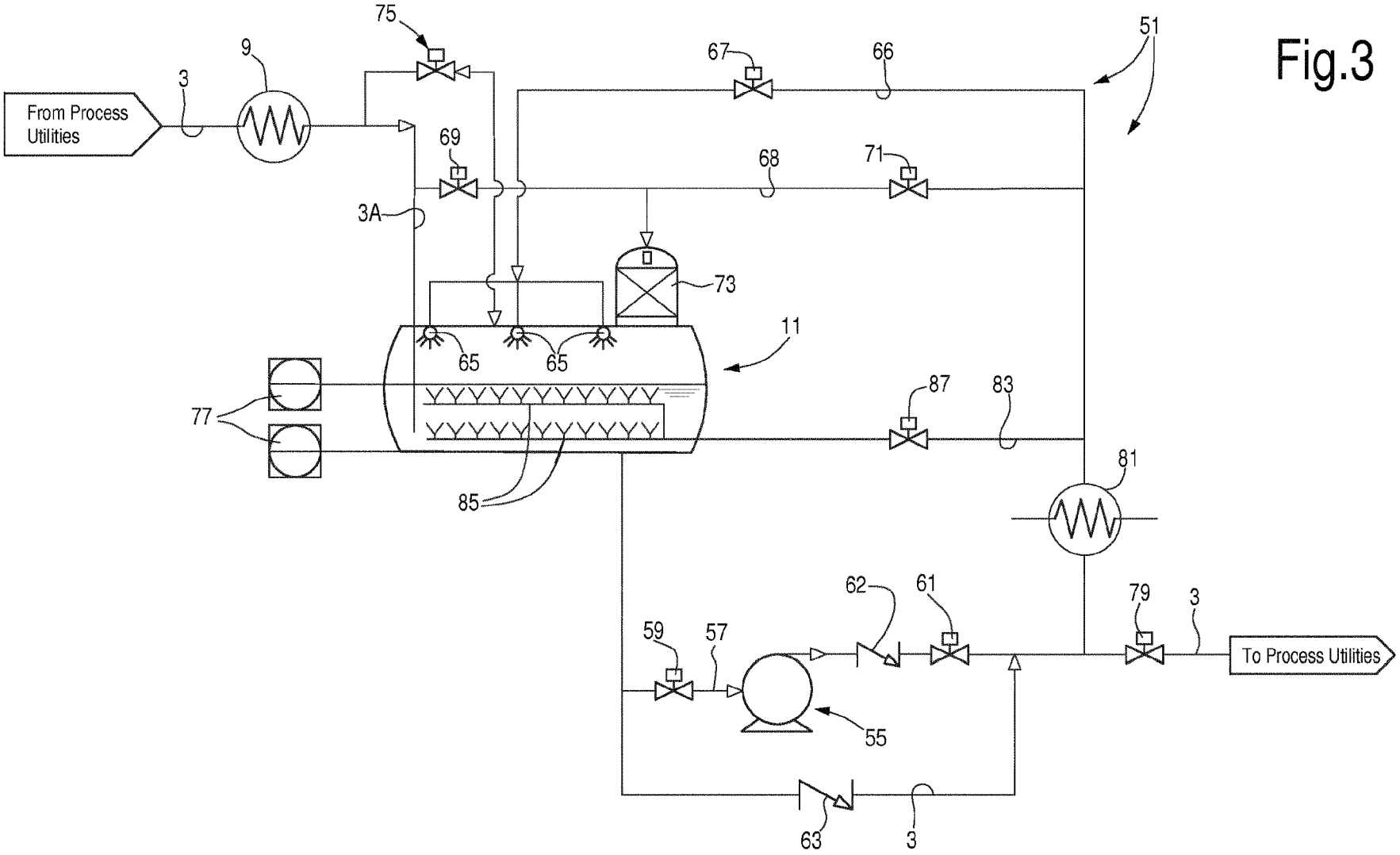
FIG. 3 illustrates a working fluid accumulation vessel and a chilling arrangement combined therewith, according to a second embodiment.

With continuing reference to FIGS. 1 and 2, a further embodiment of a chilling arrangement 51 is shown in FIG. 3. The same reference numbers designate the same or corresponding parts, elements or components already illustrated in FIG. 2 and described above, and which will not be described again. The chilling arrangement 51 of FIG. 3 differs from the chilling arrangement of FIG. 2 mainly in that heat exchanger 53 submerged in the liquefied working fluid contained in the fluid collection vessel 11 is replaced by an external heat exchanger 81. The heat exchanger 81 forms part of a heat removal device adapted to remove heat from liquefied working fluid removed from the fluid collection vessel 11 and circulating in a hot side of the heat exchanger 81, in heat exchange relationship with a refrigerant circulating in the cold side of the heat exchanger 81. The refrigerant removes heat from the liquefied working fluid pumped by circulation pump 55 during the pressure reduction process prior to startup of the thermodynamic system 1.

Liquefied working fluid circulating through the hot side of the heat exchanger 81 can be delivered through a delivery line 83 to submerged nozzles 85, which can be arranged at different levels in the liquefied working fluid contained in the fluid collection vessel 11. The submerged nozzles 85 form part of a first heat removal device, adapted to remove heat from the liquefied working fluid contained in the fluid collection vessel 11.

A valve 87 can selectively open or close the delivery line 83. By acting upon control valves 67, 69, 71 87, working fluid pumped by circulation pump 55 can be delivered selectively to the submerged nozzles 85, to the quench valves 65, to the non-condensable fluids removing device 73 and/or to fluid delivery duct 3A.

The chilling arrangement 51 of FIG. 3 can operate as follows. When a reduction of the settle-out pressure in closed circuit 3 is required to restart the thermodynamic system 1, valve 69 can be closed (valves 79, 71, 67 have been already closed upon tripping of the pressure boosting arrangement 5 or during normal operation); valves 87 and 71 can be opened and the circulation pump 55 starts operating. Liquefied working fluid is sucked by pump 55 from the bottom of the fluid collection vessel 11 and delivered through the heat exchanger 81. Heat can be removed by the refrigerant in heat exchanger 81 and the chilled liquefied working fluid can be returned through line 83 in the fluid collection vessel 11. Once the temperature of the liquefied working fluid in fluid collection vessel 11 has been reduced, i.e. the liquefied working fluid has been sub-cooled, at least a portion of the liquefied working fluid circulated by circulation pump 55 can be delivered to the quench valves 65 through line 66 and valve 67, which is opened. The liquefied working fluid sprayed through quench valves 65 at low pressure in the fluid collection vessel 11 promotes condensation of the gaseous working fluid.

The valve 71 can be opened during or preferably after sub-cooling of the liquefied working fluid in the fluid collection vessel 11.

The pressure in the closed circuit 3 is thus reduced and the thermodynamic system 1 can be re-started once a suitable low pressure threshold has been reached.

As mentioned in connection with FIG. 2, also in FIG. 3 the refrigerant circulating in the heat exchanger 81 can be provided by a different process of the plant where the thermodynamic system 1 is arranged, or can be provided by a dedicated refrigeration circuit.

With continuing reference to FIGS. 1, 2 and 3, FIG. 4 illustrates a further embodiment of a chilling arrangement 51 combined with the fluid collection vessel 11. The same reference numbers used in FIGS. 2 and 3 are used in FIG. 4 to designate the same or corresponding parts, components or elements, which will not be described again. The embodiment of FIG. 4 differs from the embodiment of FIG. 3 mainly in that no submerged nozzles and no line 83 for delivering liquefied working fluid thereto are provided.

Figure 4:
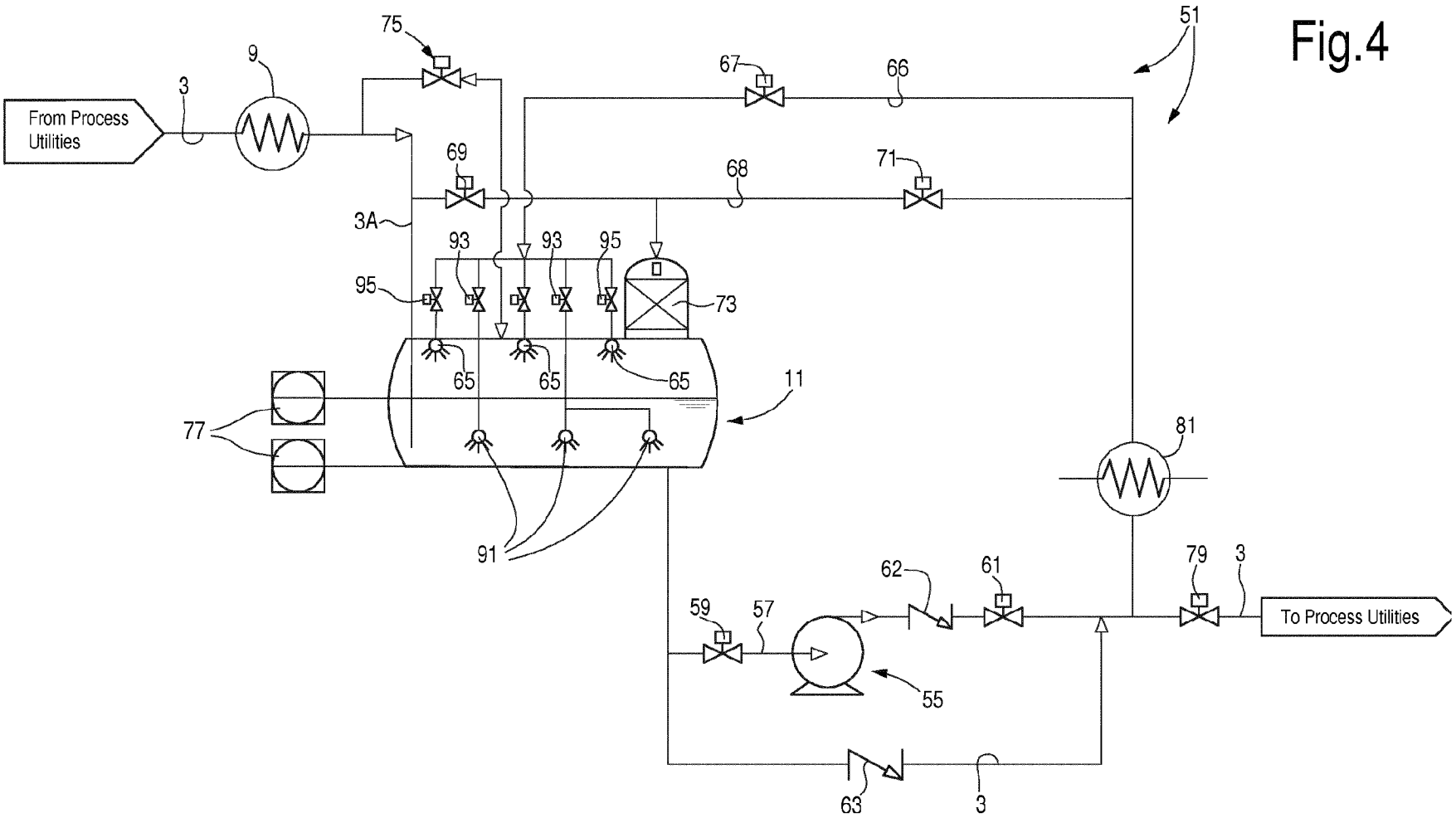
FIG. 4 illustrates a working fluid accumulation vessel and a chilling arrangement combined therewith, according to a third embodiment.

Contrary to the embodiment of FIG. 3, in FIG. 4 the flow of liquefied working fluid delivered by the circulation pump 55 to the line 66 can be delivered selectively to quench valves 65 or to bubblers 91, submerged in the liquefied working fluid contained in the fluid collection vessel 11. In the embodiment of FIG. 4 the bubblers 91 form part of a first heat removal device adapted to remove heat from the liquefied working fluid contained in the fluid collection vessel 11. The bubblers 91 can be arranged at different heights in the liquefied working fluid.

To deliver the liquefied working fluid selectively to the submerged bubblers 91 and/or to the quench valves 65, in some embodiments control valves 95 are arranged between line 66 and the quench valves 65. Additionally, control valves 93 can be arranged between line 66 and the submerged bubblers 91.

In some embodiments the control valves 93 are configured as expansion valves, for instance as Joule-Thomson valves, such that the liquefied working fluid pressurized by circulation pump 55 will be partially vaporized and cooled down while flowing through the expansion valves 93. The fluid exiting the submerged bubblers 95 can chill the liquefied working fluid to bring it to sub-cooled conditions.

As described in connection with the embodiments of FIGS. 2 and 3, also in the embodiment of FIG. 4 the chilling arrangement 51 can be controlled such that a first sub-cooling step is performed, to bring the liquefied working fluid contained in the fluid collection vessel 11 at sub-cooled conditions, prior to spraying working fluid through the quench valves 65. This can be achieved by timely controlling opening and closing of valves 93 and 95.

Figure 5:
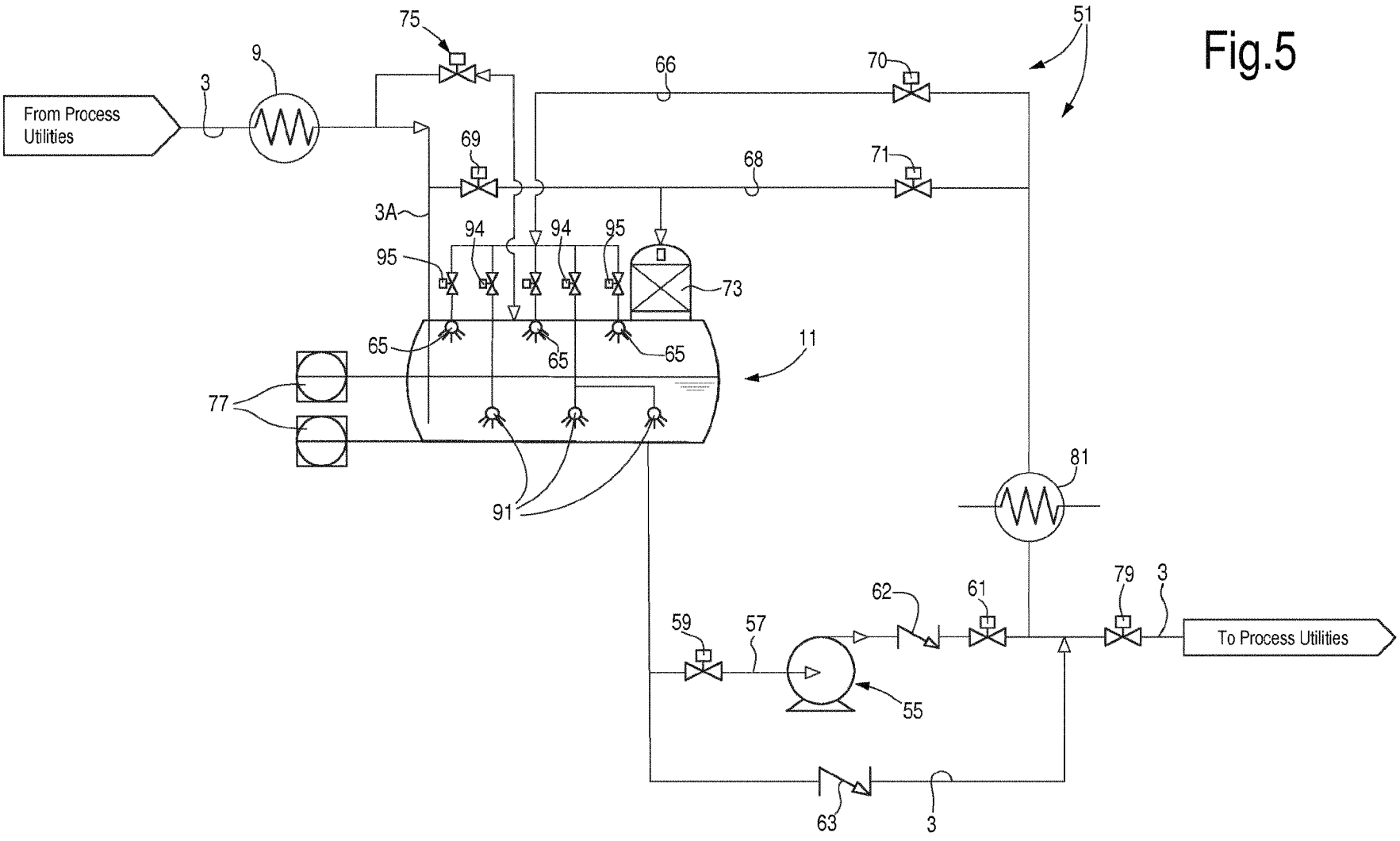
FIG. 5 illustrates a working fluid accumulation vessel and a chilling arrangement combined therewith, according to a fourth embodiment.

Referring to FIG. 5, with continuing reference to FIGS. 1, 2, 3 and 4, a further embodiment of the chilling arrangement 51 is disclosed. The chilling arrangement 51 of FIG. 5 differs from the chilling arrangement 51 of FIG. 4 mainly in that the Joule-Thomson valves 93 are replaced by simple opening and closing control valves 94, while a Joule-Thomson valve 70 is arranged along line 66 instead of control valve 67. Quench valves 65 can be replaced by simple bi-phase fluid distribution nozzles 64.

The chilling arrangement 51 of FIG. 5 can perform the same pressure reduction process as described above, by controlling the operation of the circulation pump 55 to circulate liquefied working fluid from the bottom of the fluid collection vessel 11 through the heat exchanger 81, wherein the liquefied working fluid is cooled by heat exchange against the refrigerant circulating in the heat exchanger 81. Chilled liquefied working fluid is expanded and partially vaporized in the Joule-Thomson valve 70 and can be delivered selectively to the submerged bubblers 91 and/or to the bi-phase fluid distribution nozzles 64, by selectively opening and closing the control valves 94, 95.

As described in connection with FIGS. 2, 3 and 4, also the chilling arrangement 51 of FIG. 5 can be controlled to perform firstly a step of sub-cooling the liquefied working fluid in the fluid collection vessel 11, and subsequently to start the actual process of condensing the gaseous working fluid contained therein.

Figure 6:
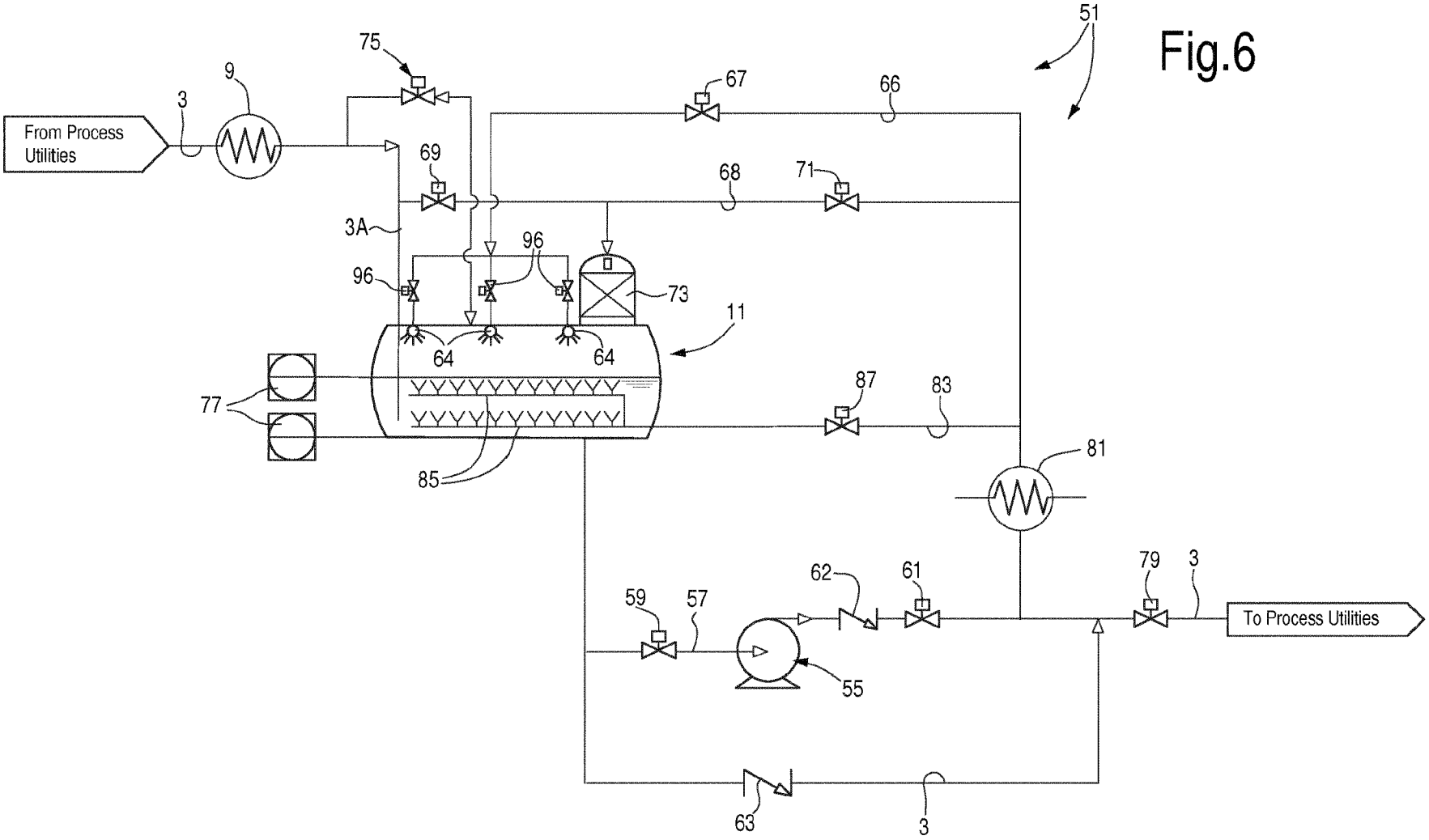
FIG. 6 illustrates a working fluid accumulation vessel and a chilling arrangement combined therewith, according to a fifth embodiment.

With continuing reference to FIGS. 1, 2, 3, 4 and 5, in FIG. 6 a further embodiment of a chilling arrangement 51 is illustrated. The chilling arrangement 51 of FIG. 6 is substantially identical to the chilling arrangement 51 of FIG. 3, except that Joule-Thomson valves 96 are arranged upstream of nozzles 64. The liquefied working fluid delivered to the Joule-Thomson valves 96 is partially vaporized through said valves and is then sprayed through nozzles 64 in the fluid collection vessel 11. Here the cold droplets contained in the sprayed flow evaporate extracting latent heat from the gaseous working fluid contained in the upper part of the fluid collection vessel 11.

Figure 7:
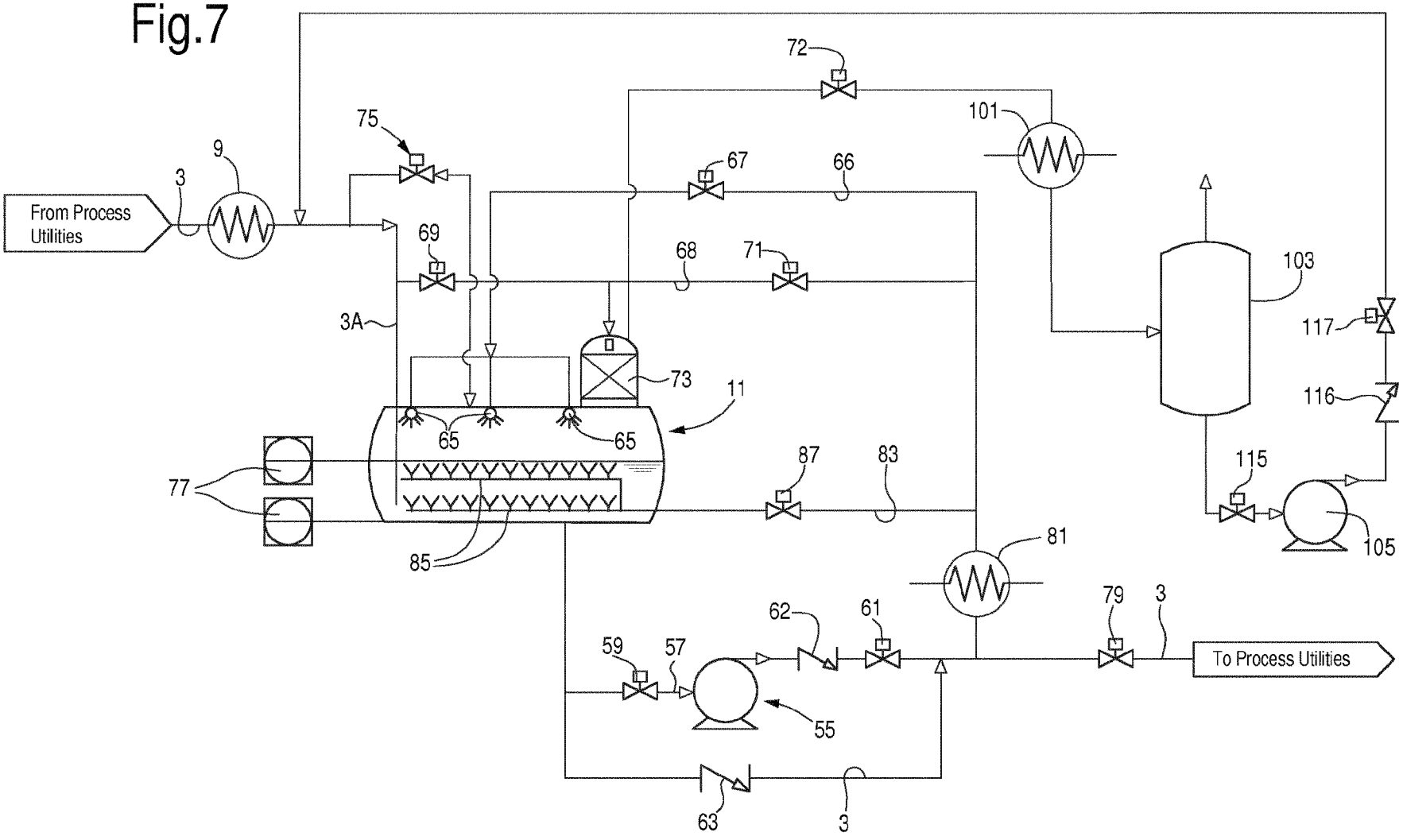
FIG. 7 illustrates a working fluid accumulation vessel and a chilling arrangement combined therewith, according to a sixth embodiment.

With continuing reference to FIGS. 1, 2, 3, 4, 5 and 6, FIG. 7 illustrates a further embodiment of a chilling arrangement 51. The arrangement of FIG. 7 is the same as in FIG. 3, with the addition of a further heat exchanger 101, wherein a refrigerant circulates in heat exchange relationship with a gas mixture coming from the non-condensable fluids removing device 73 or from a dedicated vent line and relevant vent valve, which can be directly connected to the fluid collection vessel 11.

Gaseous working fluid contained in the gas mixture is condensed, separated from non-condensable fluids in a liquid/gas separator 103 and pumped by a second pump 105 towards the fluid collection vessel 11 or to the closed circuit 3. Isolation valves 115 and 117 can be arranged on the suction side and on the delivery side of the pump 105. A check valve 116 can further be provided on the delivery side of the pump 105.

A vent valve 72 can be arranged between the device 73 and the liquid/gas separator 103. The vent valve 72 is opened during the working fluid cooling phase to reduce the pressure in the fluid collection vessel 11.

Non-condensable fluids and/or non-condensed working fluid separated from the liquefied working fluid in separator 103 can be vented.

In some embodiments the liquid/gas separator 103 can be a suction drum, such as the suction drum 23 of FIG. 1. In such case, the non-condensable fluids along with possible gaseous working fluid will not be vented, but rather delivered to the suction side 7D of compressor 7.

The refrigerant in heat exchanger 101 can be the same refrigerant circulating in heat exchanger 81 or a different refrigerant. The heat exchangers can comprise, for instance, one or a series of tube bundles. In some embodiments, the heat exchangers can comprise one or more air-coolers, multi-stream heat exchangers, such as finned plate or wound coil heat exchangers, or the like. The cold sides of heat exchangers 101 and 81 can for instance be arranged in series or in parallel.

The liquid/gas separator 103 can be any device provided in the thermodynamic system 1, such as for instance the suction drum, or else a dedicated gas/liquid separator.

Figure 8:
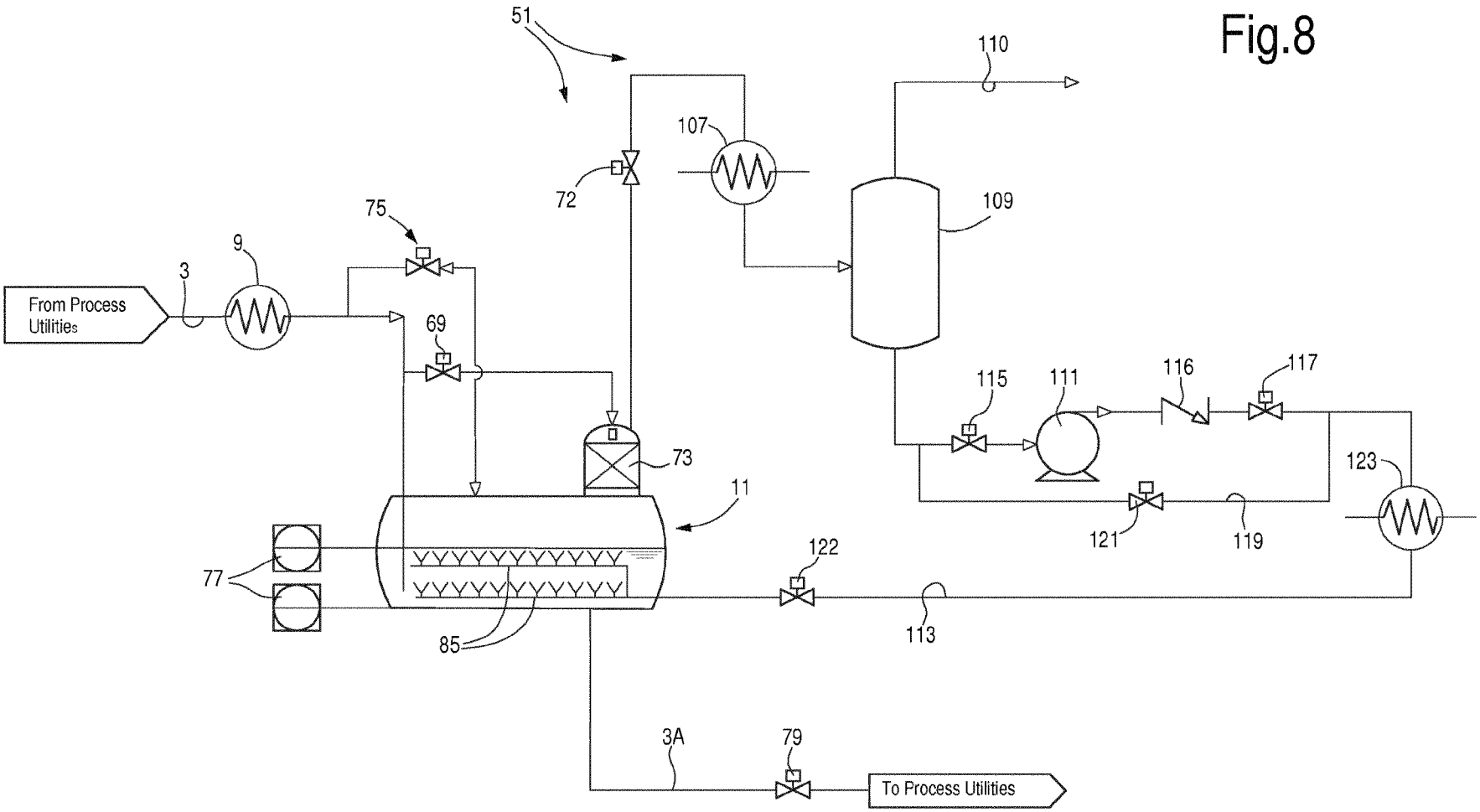
FIG. 8 illustrates a working fluid accumulation vessel and a chilling arrangement combined therewith, according to a seventh embodiment.

With continuing reference to FIGS. 1, 2, 3, 4, 5, 6 and 7, in FIG. 8 a yet further embodiment of the chilling arrangement 51 is illustrated. The same elements, parts or components already shown in FIGS. 2-7 are labeled with the same reference numbers. In FIG. 8 the fluid collection vessel 11 is provided with a siphon breaker 75 and a temperature control system 77 as described above. Submerged nozzles 85 are arranged in the lower part of the fluid collection vessel 11, under the level of the liquefied working fluid contained therein. As in the previously described embodiments, a plurality of submerged nozzles 85 can be provided at different heights inside the fluid collection vessel 11.

A non-condensable fluids removing device 73 or a venting valve is further provided, which can be directly connected to the fluid collection vessel 11, wherewith a mixed flow of gaseous working fluid and non-condensable fluids is removed from the fluid collection vessel 11 and caused to flow through a heat exchanger 107, wherein the flow is chilled in heat exchange relationship with a refrigerant circulating in the cold side of the heat exchanger 107. The partially condensed flow exiting the heat exchanger 107 is delivered to a liquid/gas separator 109. Non-condensable fluids and gaseous working fluid can be removed through a line 110, while condensed working fluid is collected from the bottom of the liquid/gas separator 109 by a pump 111 and delivered through a line 113 back to the fluid collection vessel 11. The line 113 is adapted to deliver condensed working fluid to submerged nozzles 85. As in previously described embodiments, also in this case the liquid/gas separator 109 can be a component of the thermodynamic system 1, for instance suction drum 23. In this case non-condensable fluids and/or gaseous working fluid discharged from the liquid/gas separator 109 can be delivered to the suction side of the compressor 7 or another compressor of the thermodynamic system 1.

Upstream and downstream of pump 111 a control valve 115 can be provided on the suction side of the pump 111 and a further control valve 117 can be provided on the delivery side of the pump 111. A check valve 116 can be provided on the delivery side of pump 111. A bypass line 119 can further be arranged in parallel to the pump 111. An isolation valve 121 can be arranged along the bypass line 119. A further control valve 122 can be provided along line 113.

In some embodiments, a further optional heat exchanger 123 can be provided along line 113. A refrigerant flowing in heat exchange relationship with the condensed working fluid in line 113 can remove heat therefrom to further reduce the temperature of the condensed working fluid. The heat exchangers 123 and 107 can be cooled by the same refrigerant and can be arranged in series or in parallel. The heat exchangers 123 and 107 can be, e.g., tube bundle heat exchangers, air coolers, multi-stream heat exchangers (for example finned plate or wound coil heat exchangers, or combinations thereof). Several heat exchanger elements can be arranged in series or in parallel.

When the thermodynamic system 1 is operating, the valve 122 is closed and the liquefied working fluid is delivered from the fluid collection vessel 11 to the process utilities through line 3A. The chilling arrangement 51 can be inoperative.

When the thermodynamic system 1 must be started up again after a period of inactivity, the chilling arrangement 51 is activated in order to reduce the pressure inside the closed circuit 3 from the settle-out pressure to a lower pressure threshold, at which the pressure boosting arrangement 5 can be restarted. The valve 122 is opened and valve 79 is closed.

Pump 111 is activated to circulate fluid in the line 117 and remove condensed working fluid from the liquid/gas separator 109. Gaseous working fluid and non-condensable gases start flowing from the fluid collection vessel 11 towards the heat exchanger 107, where the working fluid is condensed and collected in the bottom of the liquid/gas separator 109. Pressure in the fluid collection vessel 11 drops and working fluid is thus recalled from upstream circuit 3 through valve 69 and/or other additional ducts and valves, such as for instance the siphon breaker 75.

The condensed, liquefied working fluid from liquid/gas separator 109 is pumped by pump 111 through line 113 back in the fluid collection vessel 11, thus reducing the temperature of the working fluid contained therein and promoting condensation of the gaseous working fluid, thus reducing the pressure of the closed circuit 3. If the additional heat exchanger 123 is present, the chilling process can be accelerated.

Once the lower pressure threshold is achieved in closed circuit 3, the pressure boosting arrangement 5 can start up.

Figure 9:
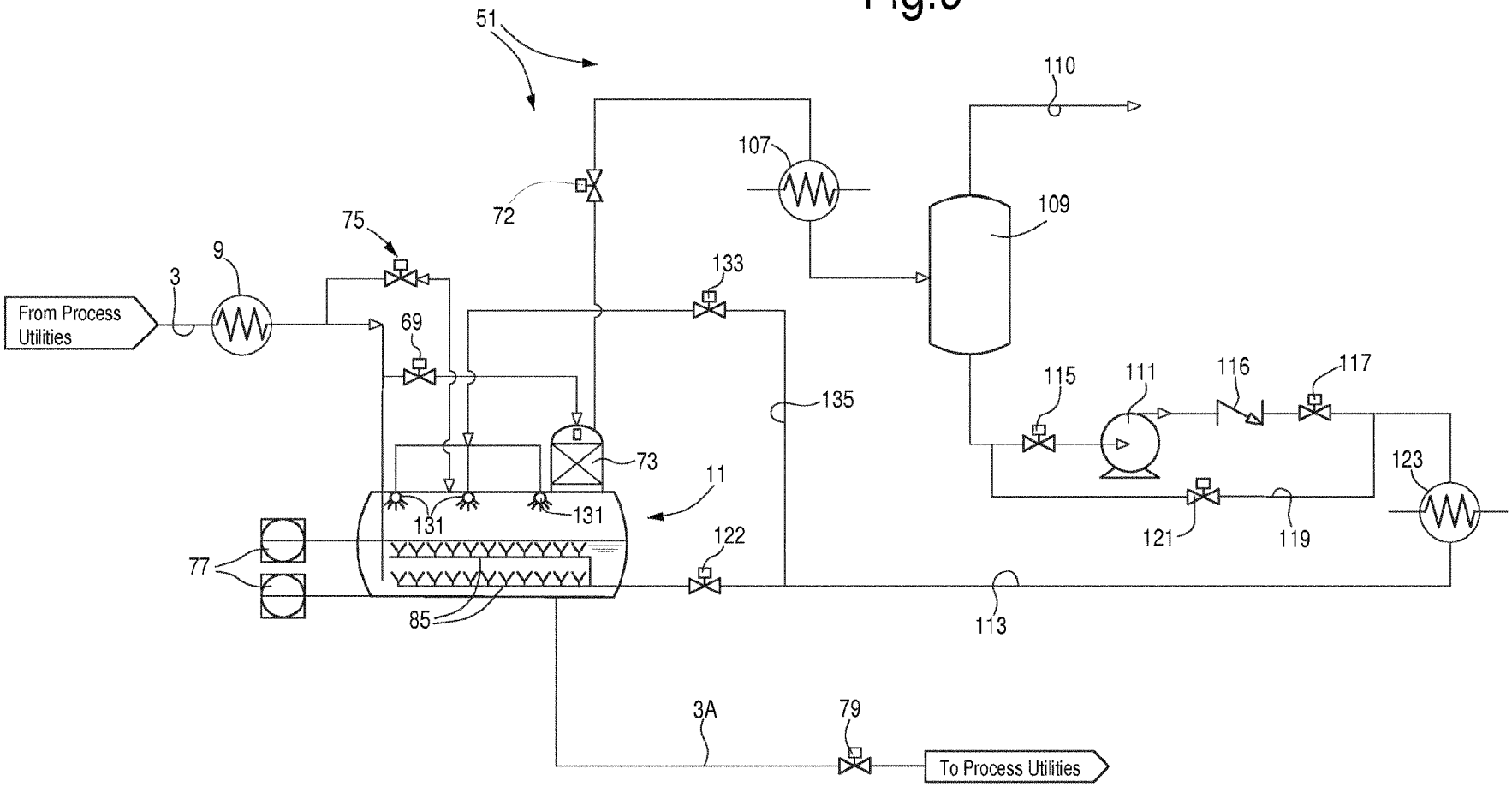
FIG. 9 illustrates a working fluid accumulation vessel and a chilling arrangement combined therewith, according to a eighth embodiment.

With continuing reference to FIGS. 1, 2, 3, 4, 5, 6, 7 and 8, in FIG. 9 a further embodiment of the chilling arrangement 51 is illustrated. The same reference numbers as used in FIG. 8 designate the same parts, components or elements, which are not described again. The chilling arrangement 51 of FIG. 9 differs from the chilling arrangement 51 of FIG. 8 in that one or more quench valves 131 are arranged in the upper portion of the fluid collection vessel 11 above the level of the liquefied working fluid contained therein. The quench valves 131 can be placed in fluid communication with line 113 through a control valve 133 and a branching line 135.

The chilling arrangement 51 of FIG. 9 operates substantially in the same way as the chilling arrangement 51 of FIG. 8. However, the chilled liquefied working fluid flowing in line 113 can be delivered selectively or alternatively to the submerged nozzles 85, to the quench valves 131 or both. The arrangement of FIG. 9 can provide for a reduced flow rate of gaseous working fluid vented through the non-condensable fluids removing device 73.

Figure 10:
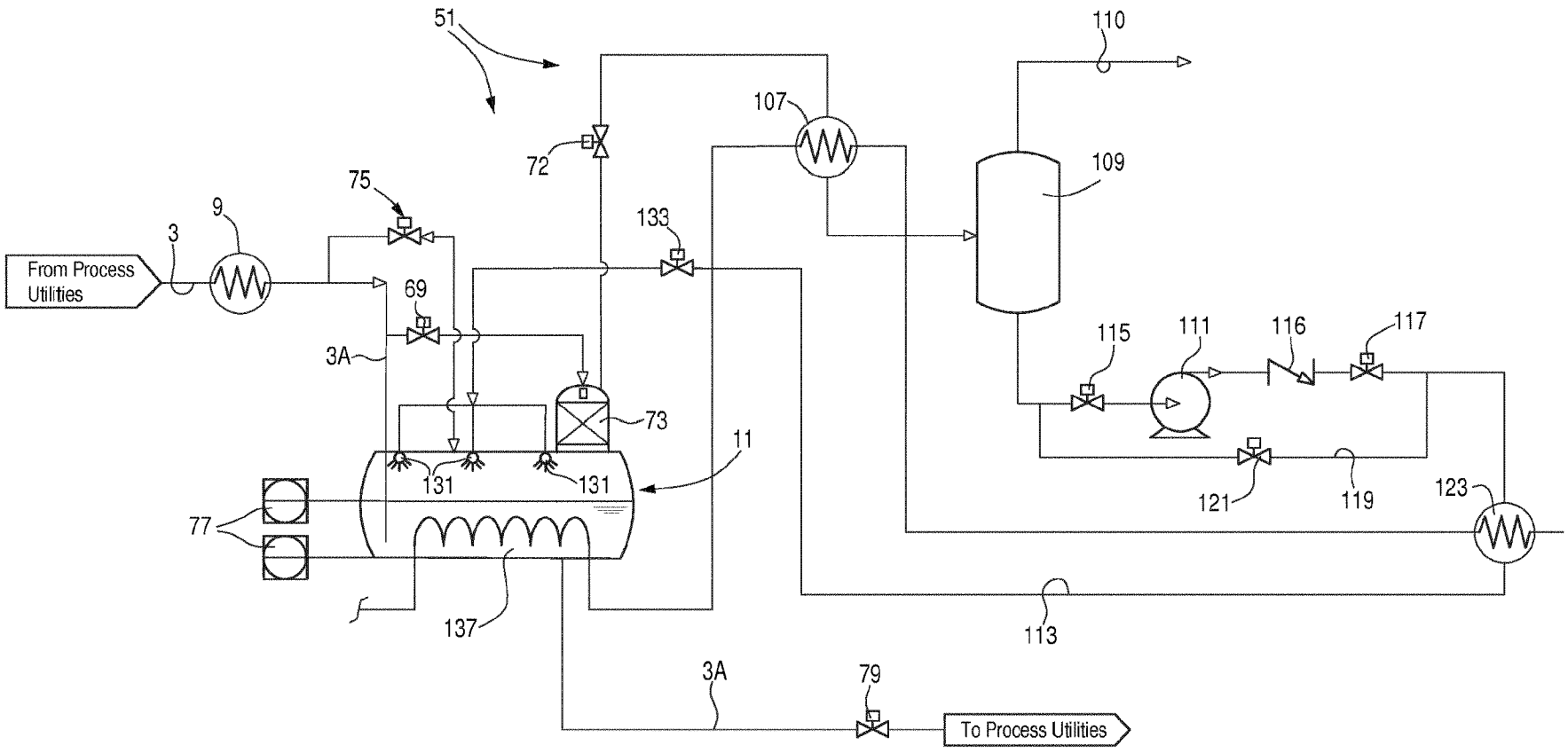
FIG. 10 illustrates a working fluid accumulation vessel and a chilling arrangement combined therewith, according to a ninth embodiment.

With continuing reference to FIGS. 1, 2, 3, 4, 5, 6, 7, 8 and 9, in FIG. 10 a further embodiment of the chilling arrangement 51 is shown. The same reference numbers of FIGS. 8 and 9 are used to designate the same or corresponding elements, parts or components shown in FIGS. 8 and 9, which will not be described again. In the embodiment of FIG. 10 the chilled liquefied working fluid from pump 111 is delivered through line 113 and control valve 133 to quench valves 131 arranged in the upper part of the fluid collection vessel 11, above the level of the liquefied working fluid contained therein. No submerged nozzles are provided in this embodiment.

In order to sub-cool the liquefied working fluid contained in the bottom part of the fluid collection vessel 11, in the embodiment of FIG. 10 a heat exchanger 137 can be provided. The heat exchanger 137 forms part of a first heat removal device adapted to remove heat from the liquefied working fluid contained in the fluid collection vessel 11.

The heat exchanger 137 can comprise a tube bundle and/or a coil submerged in the liquefied working fluid to remove heat therefrom by means of a refrigerant circulating in the heat exchanger 137. Said refrigerant can be the same refrigerant circulating in heat exchanger 107 and/or in heat exchanger 123, if present. Heat exchangers 137, 107 and/or 123 can be arranged in parallel or in series. In the embodiment shown in FIG. 10, the same refrigerant flows sequentially through heat exchangers 137, 107 and 123, which are thus arranged in series. In other embodiments, two or all three heat exchangers 137, 107, 123 can be arranged in parallel, rather than in series along the refrigerant line. The heat exchangers 107 and 123 can be, for instance, tube bundle heat exchangers, air coolers, multi-stream heat exchangers, such as finned plates or wound coil heat exchangers, or combinations thereof.

The operation of the chilling arrangement 51 of FIG. 10 is substantially the same as the operation of the chilling arrangement 51 of FIG. 9. However, a preliminary sub-cooling step, to reduce the temperature of the liquefied working fluid contained in the fluid collection vessel 11 can be performed by circulating refrigerant in the heat exchanger 137, while valve 133 is temporarily closed. Only once the liquefied working fluid in fluid collection vessel 11 has been sub-cooled, liquefied working fluid start being delivered to the quench valves 131.

The various arrangements illustrated in FIGS. 2 to 10 can be variously combined to one another. For instance, submerged nozzles 85 can be provided also in the embodiment of FIG. 9, in combination with the heat exchanger 137.

In some embodiments described above, a sub-cooling step is performed prior to start condensing the gaseous working fluid in the fluid collection vessel 11. This prevents flashing phenomena. In other less preferred embodiments, condensation of the gaseous working fluid and chilling of the liquefied working fluid can start simultaneously.

Figure 11:
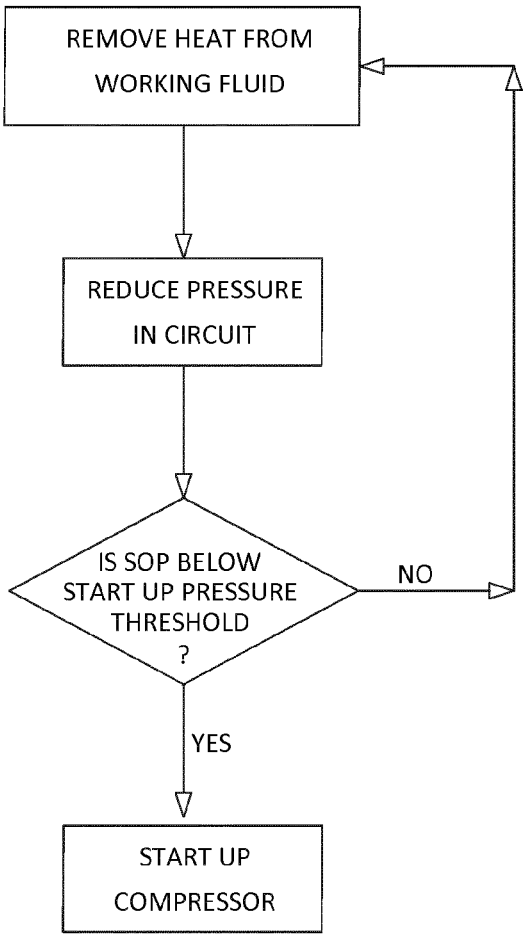
FIG. 11 and 12 illustrate flow charts of methods for re-starting a thermodynamic system according to the present disclosure.
Figure 12:
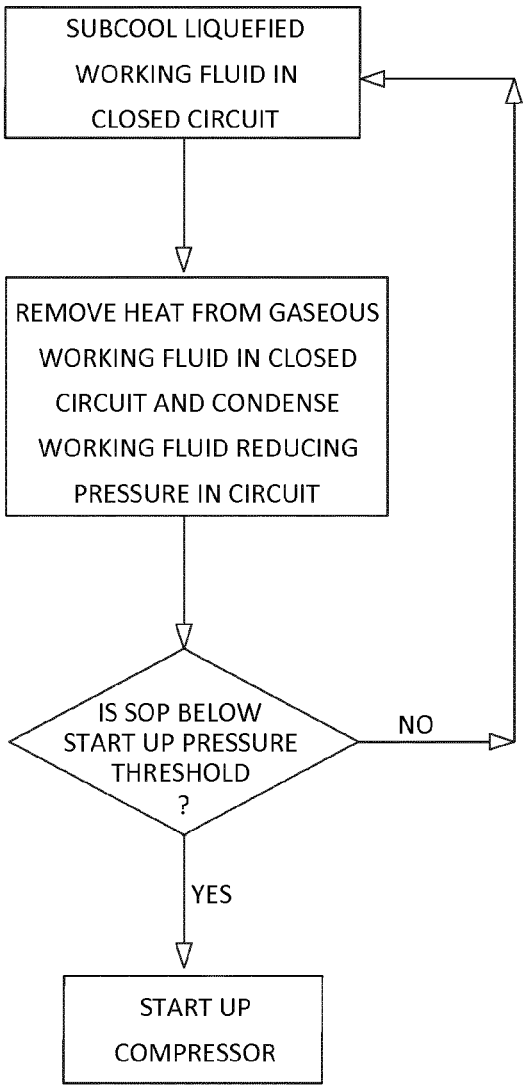

FIGS. 11 and 12 show flowcharts summarizing methods disclosed herein for reducing pressure in the closed circuit prior to startup.

While in the above disclosed embodiments a working fluid de-pressurization arrangement has been described, which is aimed at reducing the settle-out pressure in order to allow or facilitate startup of the pressure boosting arrangement following a standby period, those skilled in the art will understand that the chilling arrangement 51 can be used in different thermodynamic systems, in which internal fluid pressure reduction may be required.

Figure 13:
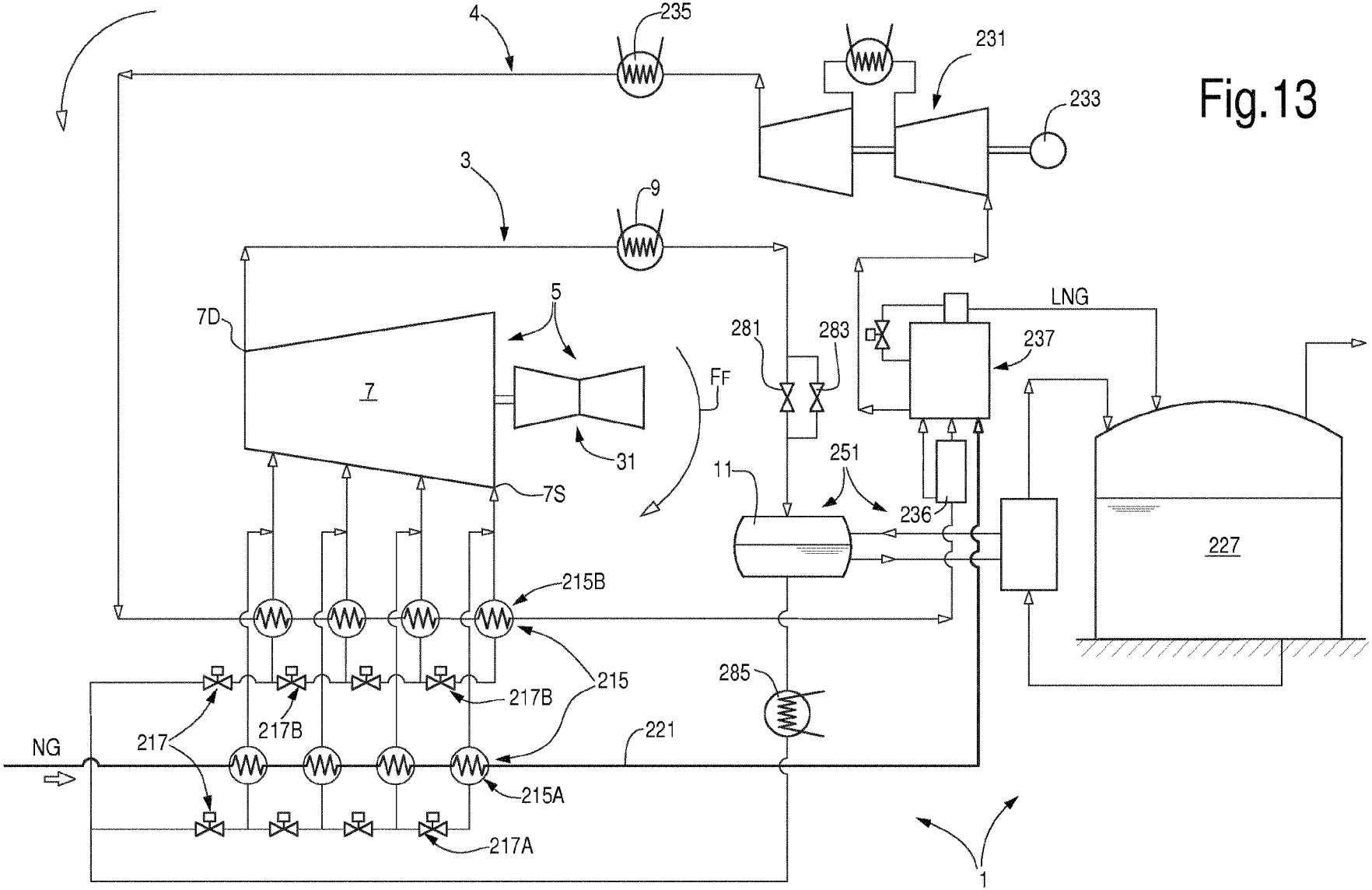
FIG. 13 illustrates a schematic of a thermodynamic system in combination with a natural gas liquefaction system.

FIG. 13 illustrates a schematic of a further embodiment of the subject matter disclosed herein. The thermodynamic system of FIG. 13 comprises a natural gas liquefaction arrangement, comprised of two combined refrigeration circuits for producing liquefied natural gas. In the example of FIG. 13 the refrigeration circuits include a propane/mixed refrigerant system, in which the propane refrigerant circuit comprises means for reducing the pressure in the propane circuit, e.g. following a period of inactivity of the propane compressor, which may lead to increased settle-out pressure (SOP). The thermodynamic system of FIG. 13 also comprises a storage unit or tank to store liquefied process fluid, i.e. liquefied natural gas. In some embodiments the liquefied natural gas is used to reduce the pressure in the propane circuit when needed. In some embodiments, the natural gas liquefaction system may include two or more refrigerant circuits using different refrigerant fluids operating at different temperatures. The refrigerant of one said circuits can be used to reduce the pressure in another of said circuits. For instance, the natural gas liquefaction system may include a low-temperature nitrogen circuit with a nitrogen storage facility, where liquefied nitrogen is stored. Liquefied nitrogen can be used to reduce the pressure in a higher-temperature refrigeration circuit, for instance a propane or a mixed-refrigerant circuit.

In some embodiments, a natural gas liquefaction system (LNG system) may include a storage of liquefied nitrogen, which is not processed in a refrigeration cycle. In such case, the stored liquefied nitrogen can again be used as a refrigerant to reduce pressure in a refrigeration cycle, for instance following tripping of the compressor.

Those skilled in the art of gas liquefaction will understand that novel features of the method and system disclosed herein can be used for reducing the internal pressure of the mixed refrigerant circuit, rather than or in addition to reducing the pressure in the propane circuit.

It shall also be understood that similar pressure reduction arrangements can be embodied in other natural gas liquefaction plants or systems, using different refrigeration circuits and refrigerant fluids, such as a Cascade® cycle, single mixed refrigerant (SMR) or dual mixed refrigerant (DMR) circuits, Linde® liquefaction systems, AP-X® liquefaction systems, and the like.

Features disclosed herein can be used also in liquefaction facilities designed for the production of liquefied gases other than natural gas, such as ethane, propane, butane, pentane, propylene, ammonia, nitrogen, hydrogen and the like. In general, the liquefied gas can be stored in a storage unit or tank, for example in a condition of vapor/liquid equilibrium, i.e. gas/liquid equilibrium. The liquefied gas can be used to chill a working fluid in a thermodynamic circuit, for example to reduce the pressure in a refrigerant circuit containing a refrigerant working fluid.

The thermodynamic system of FIG. 13 is labeled 1 as a whole and comprises a first closed refrigerant circuit 3, wherein a refrigerant working fluid is adapted to circulate and to undergo cyclic thermodynamic transformations, including compression, condensation, cooling and expansion. As mentioned above, by way of example in FIG. 13 the first closed refrigerant circuit 3 is a closed propane circuit of a propane/mixed refrigerant LNG system.

The working fluid is circulated in the closed refrigerant circuit 3 by means of a pressure boosting arrangement 5. In the schematic of FIG. 13, the pressure boosting arrangement 5 comprises a compressor 7 having a suction side 7S and a delivery side 7D. In other examples, not shown, the pressure boosting arrangement 5 can include more than one compressor, in any configuration, for instance a plurality of compressors arranged in series and/or in parallel.

Downstream of the pressure boosting arrangement 5, with respect to the direction of the working fluid flow schematically represented by arrow FF, a heat removal and fluid condensing arrangement 9 is provided. The heat removal and fluid condensing arrangement 9 can include a heat exchanger, for instance a liquid/air or liquid/liquid heat exchanger. In other embodiments, the heat removal and fluid condensing arrangement 9 can include any other kind of heat removal arrangement or device.

A condensate collecting vessel or fluid collection vessel 11 is arranged downstream of the heat removal and fluid condensing arrangement 9. Working fluid in a bi-phase condition of liquid/gas equilibrium can be contained in the fluid collection vessel 11.

An expansion section 217 and a heat exchange arrangement 215 are further provided along the closed refrigeration circuit 3. The expansion section may include one or more expanders, such as turbo-expanders, or expansion valves, such as Joule-Thomson valves. The heat exchange arrangement 215 can include one or more evaporators, in which the condensed and expanded working fluid from the expansion section 217 is heated by heat exchange with a flow of a process fluid to be chilled, as will be described later on.

In the schematic of FIG. 13, the pressure boosting arrangement 5 further comprises a driver 31, which generates the mechanical power required to drive the compressor 7 in rotation. The driver 31 can be an electric motor. In other embodiments, as schematically shown in FIG. 13, the driver 31 can be a mechanical-power-generating turbomachine, such as a gas turbine engine, a turboexpander or a steam turbine. In yet further embodiments, the driver 31 can include a reciprocating, internal combustion engine.

In the example of FIG. 13, the closed refrigeration circuit 3 comprises a multi-side stream compressor 7. The expansion section 217 and the heat exchange arrangement 215 are configured to expand the refrigerant working fluid at different, decreasing pressure levels, corresponding to decreasing temperatures of the refrigerant working fluid. The refrigerant working fluid is used to pre-cool a flow of natural gas flowing in a natural gas delivery line 221 and is further used to cool a flow of mixed refrigerant circulating in a second closed refrigeration circuit 4, which will be described shortly later on.

In the exemplary embodiment of FIG. 13, the expansion section 217 comprises a first set of expansion valves, e.g. Joule-Thomson valves, or a set of expanders, shown at 217A. The expansion section 217 further comprises a second set of expansion valves or expanders shown at 217B. The expansion valves of each set 217A and 217B are arranged in series, i.e. in sequence, to expand the refrigerant working fluid at gradually decreasing pressures and generate partial streams of refrigerant working fluid at said decreasing pressures. The partial streams of expanded refrigerant working fluid at the different pressure levels obtained by the expansion valves 217A exchange heat in heat exchangers 215A at variable temperatures with a flow of natural gas flowing in the natural gas delivery line 221. The partial streams of expanded refrigerant working fluid from the expansion valves 217B exchange heat at variable temperatures in heat exchangers 215B with the second refrigerant working fluid circulating in the second closed refrigeration circuit 4. The partial streams are the processed as side streams by the compressor 7.

The expansion section 217 and the pressure boosting arrangement 5 divide the refrigeration circuit 3 into a low-pressure section and a high-pressure section. The low-pressure section extends from the outlet of the expansion section 217 to the inlet of the pressure boosting arrangement 5, while the high-pressure section extends from the outlet of the pressure boosting arrangement 5 to the inlet of the expansion section 217.

The refrigerant working fluid, which circulates in the closed refrigeration circuit 3, is sequentially compressed in the pressure boosting arrangement 5, cooled and condensed in the heat removal and fluid condensing arrangement 9, expanded in the expansion section 217 and heated in the heat exchange arrangement 215 against the flow of natural gas to be chilled and liquefied.

In the exemplary thermodynamic system 1 of FIG. 13 the second closed refrigeration circuit 4 circulates a second refrigerant working fluid, e.g. a mixed refrigerant, in heat exchange relationship with the refrigerant in the first closed refrigeration circuit 3 and in heat exchange relationship with the process fluid (natural gas) to be liquefied. The second closed refrigeration circuit 4 comprise by way of example a compressor section 231 comprised of one or more compressors in series, driven by one or more drivers 233, e.g. electric motors, gas turbine engines, steam turbines or other mechanical power generating machines.

The compressed refrigerant working fluid of circuit 4 (mixed refrigerant) is cooled down in a cooler 235 and chilled and at least partly condensed in the heat exchangers 215B. Partly liquefied mixed refrigerant is delivered to a liquid-vapor separator 236 and the separate liquid and vapor streams from the separator 236 are circulated in a main cryogenic heat exchanger 237 (MCHE). Expanded second refrigerant working fluid further chills and liquefies the natural gas by heat exchange therewith in the main cryogenic heat exchanger 237. Heated second refrigerant working fluid is then delivered to compressors 231 to be compressed again and circulated again in the above described loop.

Liquefied natural gas from the main cryogenic heat exchanger 237 is collected and stored in the storage unit or storage tank 227, wherefrom it can be delivered towards one or more users or facilities, such as transportation facilities, e.g. to an LNG carrier. Reference number 224 indicates an LNG delivery duct, fluidly coupled to a cryogenic feeding pump 226.

As described above in connection with FIG. 1, in some circumstances the pressure inside the closed refrigeration circuit 3 can increase, for instance if the circulation of refrigerant working fluid is interrupted for whatever reason. The temperature increase will cause a pressure increase in the closed circuit 3, which requires action to be taken in order to re-start working fluid circulation in the closed refrigeration circuit 3.

As will be described herein in connection with the following figures, cooling of the working fluid and thus pressure reduction in the closed refrigeration circuit 3 can be achieved by means of a chilling arrangement 251, which uses liquefied process fluid contained in the process fluid storage unit 227.

Figure 14:
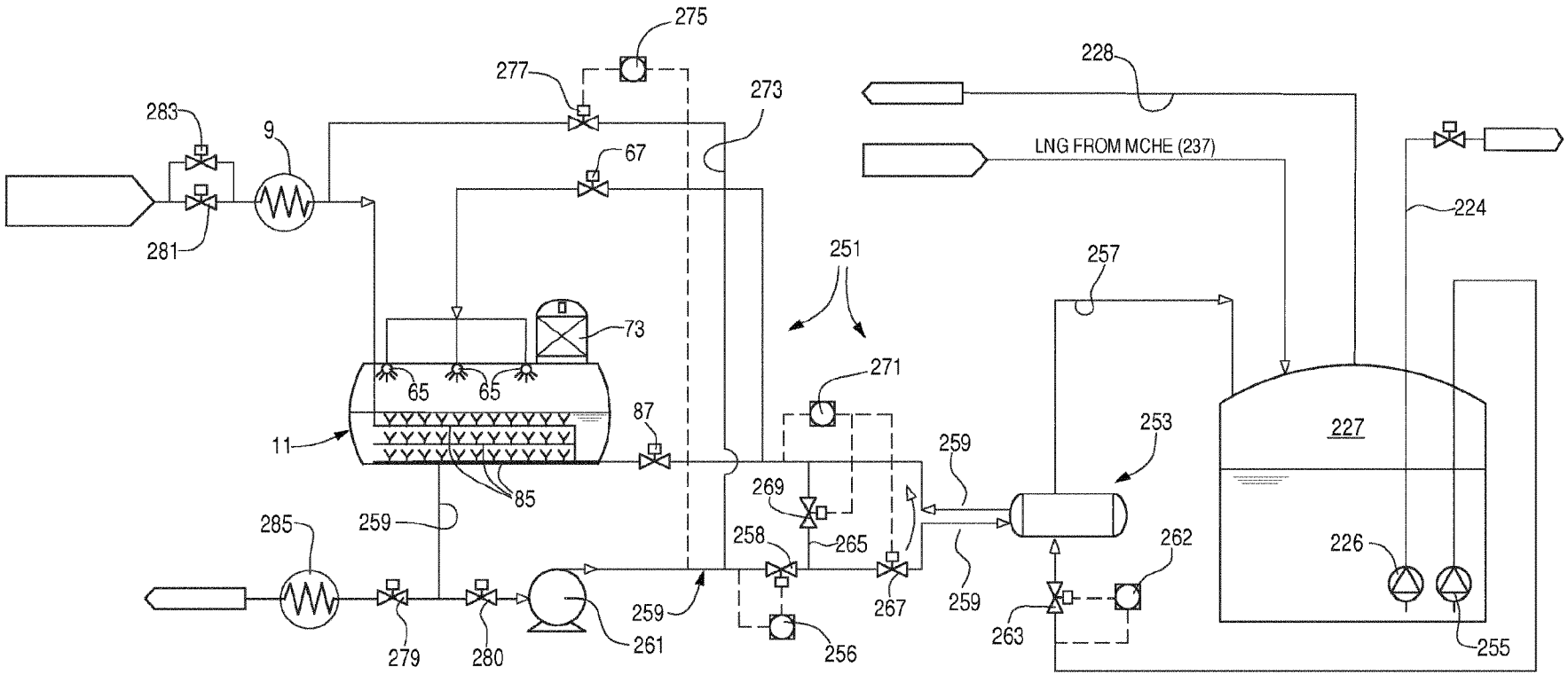
FIG. 14 illustrates an embodiment of a liquefied gas storage tank of the arrangement of FIG. 13, in combination with a working fluid collection vessel and relevant chilling arrangement in one embodiment.

With continuing reference to FIG. 13, FIGS. 14 illustrates a first example of a chilling arrangement 251 for reducing the pressure in the closed refrigeration circuit 3. The same reference numbers indicate components and elements shown in FIG. 13 and already described above. More specifically, in FIG. 14 the storage unit or storage tank 227 is shown, in combination with working fluid collection vessel 11 and the heat removal and fluid condensing arrangement 9. The chilling arrangement 251 comprises a heat exchanger 253, which is adapted to circulate a flow of process fluid from the storage unit 227 on the cold side thereof and a flow of working fluid from the closed refrigeration circuit 3 on the hot side of the heat exchanger 253. The liquefied process fluid from the storage unit 227 is heated and can evaporate, removing heat from the flow of working fluid from the closed refrigeration circuit 3, such that the pressure in the latter can be reduced, if so required.

The cold side of the heat exchanger 253 can be fluidly coupled to the bottom of the storage unit 227, where a submerged cryogenic pump 255 can be arranged, which delivers liquefied process fluid to the heat exchanger 253. A return path 257 returns the process fluid, which can be partly or entirely evaporated, to the storage unit 227.

The hot side of the heat exchanger 253 is part of a loop 259 where a circulation pump 261 is arranged. The circulation pump 261 is adapted to remove liquid working fluid from the pressurized fluid collection vessel 11 and circulate the working fluid in the loop 259. A flow controller 256 acting upon a flow control valve 258 can be provided to control the flow rate of the working fluid through loop 259.

The working fluid circulated by pump 261 in the loop 259 is cooled by heat exchange with the liquefied process fluid in the heat exchanger 253. In some embodiments, the flow of liquefied process fluid delivered to the cold side of the heat exchanger 253 can be controlled by suitable control arrangements. For instance, if a kettle heat exchanger is used, a level controller (not shown) functionally coupled to a flow-rate control valve can maintain the level of liquefied process fluid in the heat exchanger 253 at or around a pre-set level. In other embodiments, a flow controller 262 can be used to control the process fluid flow rate through a controlled flow-rate valve 263, as shown in FIG. 14.

The heat exchanger 253 can be a vertical or horizontal shell and tube heat exchanger, a kettle, a plate and fin heat exchanger, a cold box or a combination thereof, for instance. In the schematic of FIG. 14, by way of non-limiting example, the heat exchanger 253 is a horizontal shell and tube heat exchanger.

A by-pass line 265 can be provided in the loop 259 in parallel to the heat exchanger 253. Suitable devices can be provided to adjust the working fluid flow rate through the by-pass line 265 and through the heat exchanger 253, for instance in order to maintain the working fluid temperature in the return branch of the loop 259, down-stream of the bypass tie-in, at or around a set temperature value. In some embodiments, valves 267, 269 and a temperature controller 271 can be provided for controlling the temperature of the working fluid returned from the heat exchanger 253 towards the working fluid collection vessel 11. The temperature controller 271 modulates the flow rate through valves 267 and 269, such that the desired delivery temperature of the working fluid to the working fluid collection vessel 11 is maintained. In other embodiments, not shown, only one valve, e.g. valve 269, and the temperature controller 271 can be provided. Other control systems may be used for control purposes, adapted to manipulate the working fluid and flow rate, the process fluid flow rate, or the pressure thereof.

The working fluid which has been chilled in the heat exchanger 253 can be returned to the fluid collection vessel 11 through submerged nozzles 85 or through quench valves or a combination thereof, such that the cold working fluid flow returning from the circuit 259 mixes with warmer working fluid contained in the fluid collection vessel 11. Different arrangements for the same purpose can be envisaged, for instance those disclosed above in combination with one or more of FIGS. 2 to 12.

Control valves 67 and 87 can be used to modulate and control the flowrate of chilled working fluid to the quench valves 67 and/or the submerged nozzle 85, respectively.

In some embodiments, a by-pass 273 couples the delivery side of the circulation pump 261 to the inlet of the fluid collection vessel 11. A flow controller 275 can be functionally coupled to a valve 277 on by-pass 273, to modulate the flowrate through the by-pass 273, to control a minimum pump flow rate. With this arrangement, the pump 261 can be maintained in operation continuously even if no working fluid is required to circulate in heat exchanger 253.

Valves 279 and 280 are arranged to fluidly couple the fluid collection vessel 11 selectively to the suction side of the circulation pump 261 and to the closed refrigeration circuit 3. Two valves 281 and 283 in parallel (see also FIG. 13) are arranged between the delivery side of the compressor 7 (not shown in FIG. 14) and the fluid collection vessel 11. Reference number 285 designates a sub-cooler which can be arranged between the fluid collection vessel 11 and the expansion section 217 (see also FIG. 13).

The operation of the arrangement disclosed so far is as follows.

When the pressure inside the closed refrigeration circuit 3 increases, e.g. following compressor tripping or shutdown and heating of the working fluid contained in the closed circuit 3, it may be desirable to reduce the pressure in the circuit before re-starting the compressor 7. This can be achieved by removing heat from the refrigerant working fluid in the fluid collection vessel 11.

Valves 279, 281, 283 are initially closed, valves 280, 87 and/or 67 are open and liquefied working fluid from the bottom of the fluid collecting vessel 11 is caused to circulate in the loop 259 by means of the circulation pump 261. Liquefied process fluid (LNG) from the storage unit 227 is fed by cryogenic pump 255 to the cold side of the heat exchanger 253 and removes heat from the hot working fluid circulating in the loop 259. The chilled working fluid is returned to the fluid collection vessel 11, thus promoting condensation of fluid therein and reducing the pressure inside the fluid collection vessel 11.

Once a desired pressure has been achieved, valve 283 can be opened, such that gaseous working fluid from the upstream section of the closed refrigeration circuit 3 flows into the fluid collection vessel 11.

When the desired pressure in the closed refrigeration circuit 3 has been achieved, pumps 261 and 255 can be shut down, valves 280, 87 and 67 can be closed and the compressor 7 (FIG. 13) can be started. Subsequently valve 279 can be opened.

The natural gas from the cold side of the heat exchanger 253 is returned to the storage unit 227 as a two phase (liquid/vapor) mixture or as a vapor phase depending upon the kind of heat exchanger used. The vaporized natural gas can be delivered through a boiled-off gas line 228 to a boiled-off gas compressor (not shown). If the natural gas from the heat exchanger 253 is in a two-phase condition, a separator (not shown) can be also provided downstream of the heat exchanger 253 to separate the liquid phase, which is returned to storage unit 227, from the vapor phase that can be delivered to a boiled-off gas system or recovered in any other way. Alternatively, the gas/liquid separation can take place in the storage unit 227 directly.

A similar chilling arrangement 251 can be provided to reduce the pressure, e.g. the SOP which is generated upon shut down of the thermodynamic system 1, in the second refrigerant working fluid circuit 4. A separate heat exchanger functionally equivalent to heat exchanger 253 can be provided, the cold side whereof is in fluid communication with the storage unit 227 and the hot side whereof is in fluid communication with a separate fluid collection vessel functionally equivalent to vessel 11 and which is fluidly coupled with the second closed refrigeration circuit 4. In some embodiments, the fluid collection vessel of the second refrigerant circuit 4 can be the separator 236 (FIG. 13) arranged between heat exchangers 215B and the main cryogenic heat exchanger 237.

In some embodiments, temperature and pressure reduction in the second refrigerant circuit 4 may require temperatures lower than those required for pressure reduction purposes in the closed refrigeration circuit 3. This is particularly the case for instance in the embodiment of FIG. 13, where propane and mixed refrigerant can be used in circuits 3 and 4, respectively. In some embodiments, lower temperature values can be achieved during cooling down for SOP reduction purposes in circuit 4 by using a combination of two different cooling media, for instance LNG and liquefied nitrogen. The two cooling media can circulate in heat exchange relationship with the refrigerant fluid of closed refrigeration circuit 4 in separate and sequentially arranged heat exchangers.

In some embodiments, a more compact arrangement can be provided. For instance, if (as in the example of FIG. 13) the thermodynamic system 1 comprises a propane/mixed refrigerant LNG plant, a complete separation between the two closed refrigeration circuits is not needed. As a matter of fact, usually mixed refrigerant contains, among other components, also propane. It is thus possible using the same heat exchanger 253 of the chilling arrangement 251 to reduce the fluid pressure in both the first closed refrigeration circuit 3 (containing propane) and the second closed refrigeration circuit 4 (containing mixed refrigerant, including propane) in sequence. It may for instance be possible to first circulate propane from the first closed refrigeration circuit 3 through the chilling arrangement 251. Once the required pressure in the first closed refrigeration circuit 3 has been achieved, the hot side of the heat exchanger 253 can be disconnected from the first closed refrigeration circuit 3 and connected to the second closed refrigeration circuit 4. The opposite sequence, though possible in principle, may result in a contamination of the propane circuit by the other components forming the mixed refrigerant, which is undesirable.

If depressurization of circuit 3 is to be repeated, a propane purging step may be beneficial, to remove mixed refrigerant residues from the propane circuit.

While using the liquefied natural gas to chill the refrigerant working fluid contained in the first closed refrigeration circuit 3 and in the second closed refrigeration circuit 4 can be particularly advantageous, other options are not ruled out.

In some embodiments, not shown, the cold side of the heat exchanger 253 can be fluidly coupled to a tank of a different liquefied gas, for instance liquefied nitrogen. The evaporated nitrogen from the heat exchanger 253 can be vented in the atmosphere or alternatively recovered in a refrigeration cycle. If a bi-phase (liquid/vapor) mixture is available at the exit side of the heat exchanger 253, the liquid and vapor phases can be separated in a separator and the liquid phase can be recovered, while the vapor phase can be vented, or alternatively recovered in a refrigeration cycle.

While in the embodiment of FIG. 14 the storage unit 227 is the same storage tank where the liquefied natural gas from the main cryogenic heat exchanger 237 is collected, this is not the only available option. In some embodiments, not shown, an additional, separate LNG storage tank can be provided, where LNG for chilling purposes is contained, separately from the main LNG storage unit. The separate LNG storage tank may have a double function, namely LNG storage and liquid/vapor separation. This separate LNG storage tank may be used to perform the two phase (liquid/vapor) separation during cooling down of the thermodynamic system 1. This can be particularly beneficial in several situations. For instance, the main LNG storage unit can be located distant from the LNG production system. An additional LNG storage tank, separate from the main LNG storage facility, can be provided and located near the vessel 11. The LNG storage tank 227 can for instance be part of a package, including the chilling arrangement 251 and an additional small start-up accumulator, for instance. The package can easily be used to upgrade an existing LNG production plant. If a separate additional process fluid storage unit 227, separate from the main LNG storage facility is provided, interfacing of the package with the existing LNG production plant is made easier.

The above alternatives and modifications can be applied also to other embodiments described here below.

Figure 15:
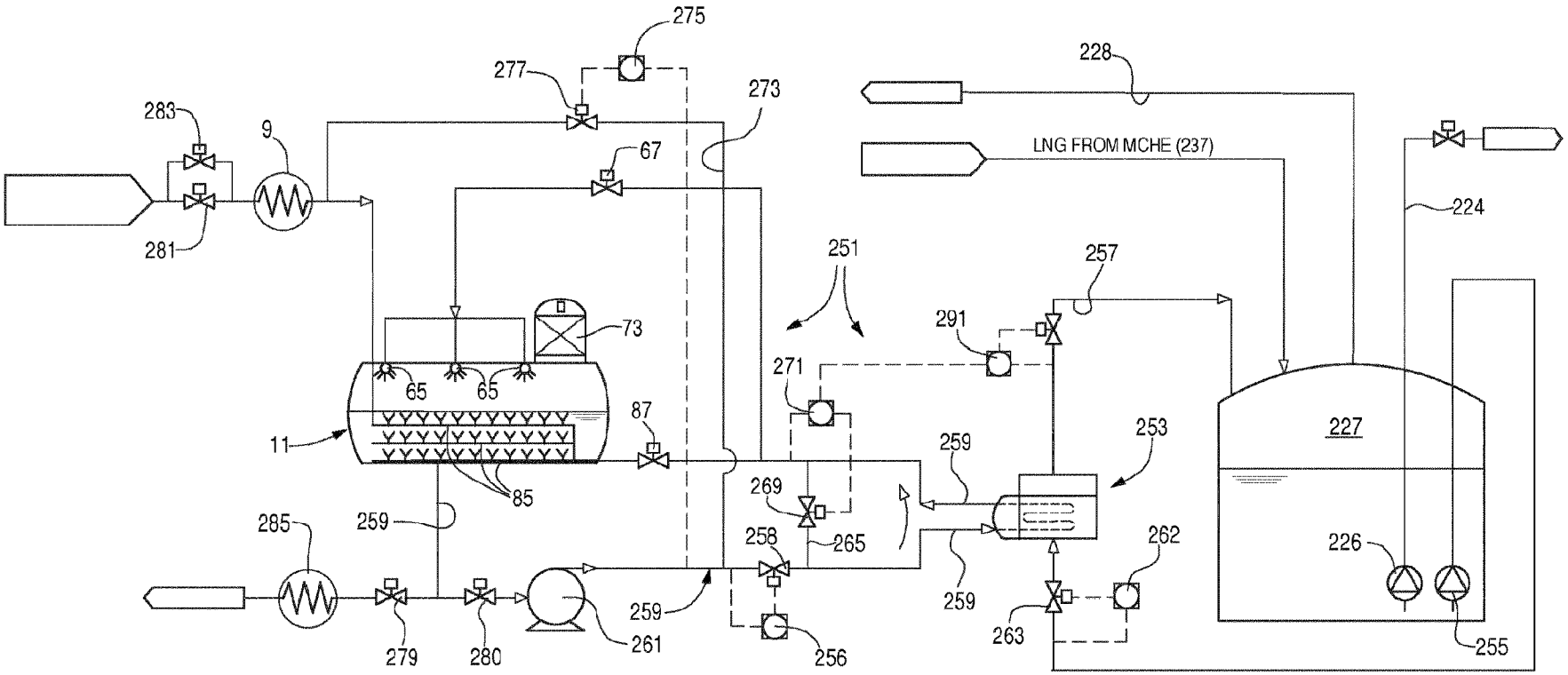
FIG. 15 illustrates a further embodiment of a liquefied gas storage tank of the arrangement of FIG. 13, in combination with a working fluid collection vessel and relevant chilling arrangement.

FIG. 15 illustrates a further embodiment of the chilling arrangement 251. The same reference numbers as in FIG. 14 designate the same or corresponding parts, elements or components, which will not be described again. In FIG. 15 the temperature controller 271, which modulates a by-pass flow in bypass line 265 to maintain the temperature of the working fluid returned to the fluid collection vessel 11 at a set-point temperature value, is functionally coupled to a pressure controller 291. This latter is functionally coupled to a valve 293 on the outlet of the cold side of heat exchanger 253, to control a set-point of the LNG evaporation pressure. The temperature of the hot side of the heat exchanger 253 can be controlled acting upon the by-pass flowrate through the by-pass line 265 using the temperature controller 271. In some embodiments, the heat exchanger 253 can be in the form of a kettle, where fluid from the LNG storage unit 227 is contained in a condition of liquid/vapor equilibrium, such that evaporation latent heat is absorbed by the LNG from the working fluid circulating in the hot side of the heat exchanger 253.

In other embodiments, the temperature controller 271 and the pressure controller 291 can be independent from one another, i.e. not coupled to one another, and only a by-pass valve 269 operated by the temperature controller 271 can be provided.

In some embodiments, the temperature difference between the cold side and the hot side at the inlet of the heat exchanger 253 can be controlled to prevent damages due to excessive temperature gradient between the hot fluid from the fluid collection vessel 11 and the cold fluid from the storage unit 227.

Figure 16:
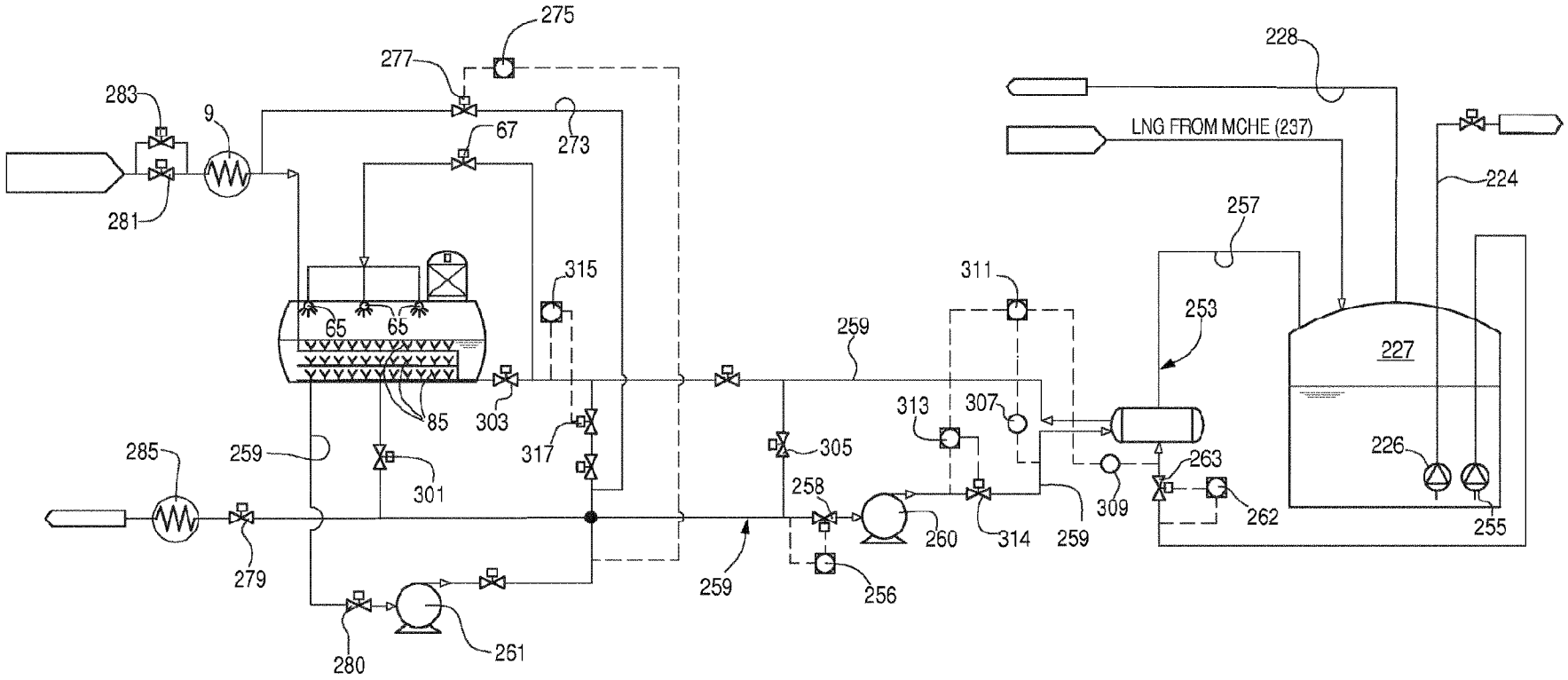
FIG. 16 illustrates a further embodiment of a liquefied gas storage tank of the arrangement of FIG. 13, in combination with a working fluid collection vessel and relevant chilling arrangement.

FIG. 16 illustrates a layout of the chilling arrangement 251, which includes temperature gradient control measures for this purpose. The same reference numbers designate parts, elements and components already described in connection with the preceding figures and which will not be described again. In the layout of FIG. 16, fluid from the fluid collection vessel 11 can be circulated in the hot side of the heat exchanger 253 by means of two pumps 261 and 260. The suction side of pump 261 is connected to the fluid collection vessel 11 through a valve 280, while the suction side of pump 260 is connected to the fluid collection vessel 11 through a valve 301. The delivery side of pump 261 is coupled to the suction side of pump 260 and to the submerged nozzles 85 and/or the quench valves 65. The return of loop 259 from the heat exchanger 253 is selectively coupled through valve 305 with the suction side of pump 260. A temperature controller 311 is functionally coupled to temperature sensors 307 and 309, adapted to detect the temperature at the inlet of heat exchanger 253, respectively on the hot side and on the cold side.

The operation of the arrangement of FIG. 16 can be as follows. While valves 279 and 280 are closed and valves 301 and 303 are open, pump 260 can be operated to ensure that loop 259 is filled with hot working fluid from the fluid collection vessel 11. Once the loop 259 has been filled, valve 301 is closed and the pump 260 is operated under controlled flow rate such that the temperature of the small amount of liquid in loop 259 is reduced at a pre-set rate, e.g. 1° C. per minute, until a given temperature is achieved, e.g. such that a difference of some degrees Celsius (say 10-30° C.) between the hot inlet side and the cold inlet side of heat exchanger 253 is achieved. During this phase, the pump 261 can be inoperative. Alternatively, pump 261 can be operative, provided that controller 275 maintains a minimum flow through by-pass 273. A controller 313 acts upon a control valve 314 between pump 260 and the heat exchanger 253.

Upon reaching the desired temperature difference at the heat exchanger inlet side, the pump 261 can be activated and valve 280 can be opened. The flowrate in the loop 259 is controlled such that on the one hand the temperature, and thus the pressure inside the fluid collection vessel 11 is gradually reduced, and on the other hand the temperature difference between the hot side and the cold side at the inlet of heat exchanger 253 is maintained under control and under a pre-set threshold. The flowrate through valves 317 and 305 can be controlled, e.g. with the aid of a temperature controller 315, such as to achieve a desired temperature set-point on the return side of loop 259 in the fluid collection vessel 11.

Figure 17:
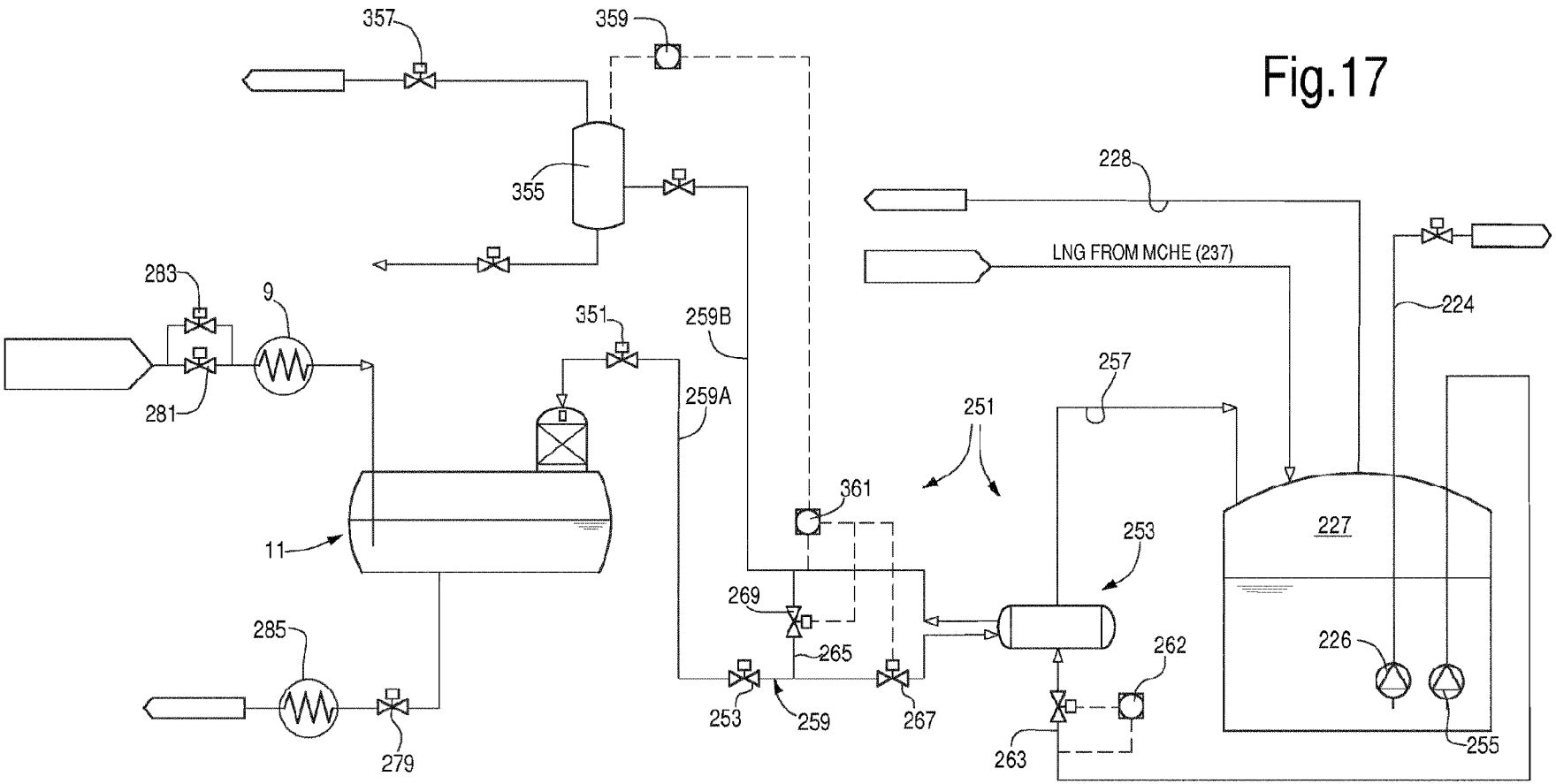
FIG. 17 illustrates a further embodiment of a liquefied gas storage tank of the arrangement of FIG. 13, in combination with a working fluid collection vessel and relevant chilling arrangement.

In the above described embodiments, fluid from the fluid collection vessel 11 is circulated in the liquid state through the heat exchanger 253 using a circulation pump. In other embodiments, the pressure inside the fluid collection vessel 11 can be used to promote circulation in the heat exchanger 253 without the aid of a pump, e.g. circulating working fluid in the gaseous state. FIG. 17 illustrates an exemplary embodiment, wherein an inlet section 259A of the loop 259 connects the top of the fluid collection vessel 11 to the hot inlet side of heat exchanger 253. A return section 259B of the loop 259 couples the hot outlet side of heat exchanger 253 directly or indirectly to the closed refrigeration circuit 3. When de-pressurization of the closed refrigeration circuit 3 is required, valves 279, 283 and 281 are closed and a valve 351 is opened, to put the fluid collection vessel 11 into fluid communication with the loop 259. A pressure control valve 353 or an orifice can control the pressure inside the loop 259 such that a gradual pressure increase is achieved in loop 259. The hot outlet side of heat exchanger 253 is fluidly coupled to a vessel 355, which is in turn coupled, via a valve 357, with the closed refrigeration circuit 3.

The pressure inside vessel 355 can be controlled via a pressure controller 359, which acts upon a temperature controller 361. The temperature set-point of temperature controller 361 can be modified based upon the pressure in vessel 355, to maintain this latter at the required set value. The temperature controller 361 can control the temperature of the chilled fluid delivered via loop 259 to vessel 355 acting upon valves 267 and 269, thus modulating the flow rate which by-passes the heat exchanger 253.

Figure 18:
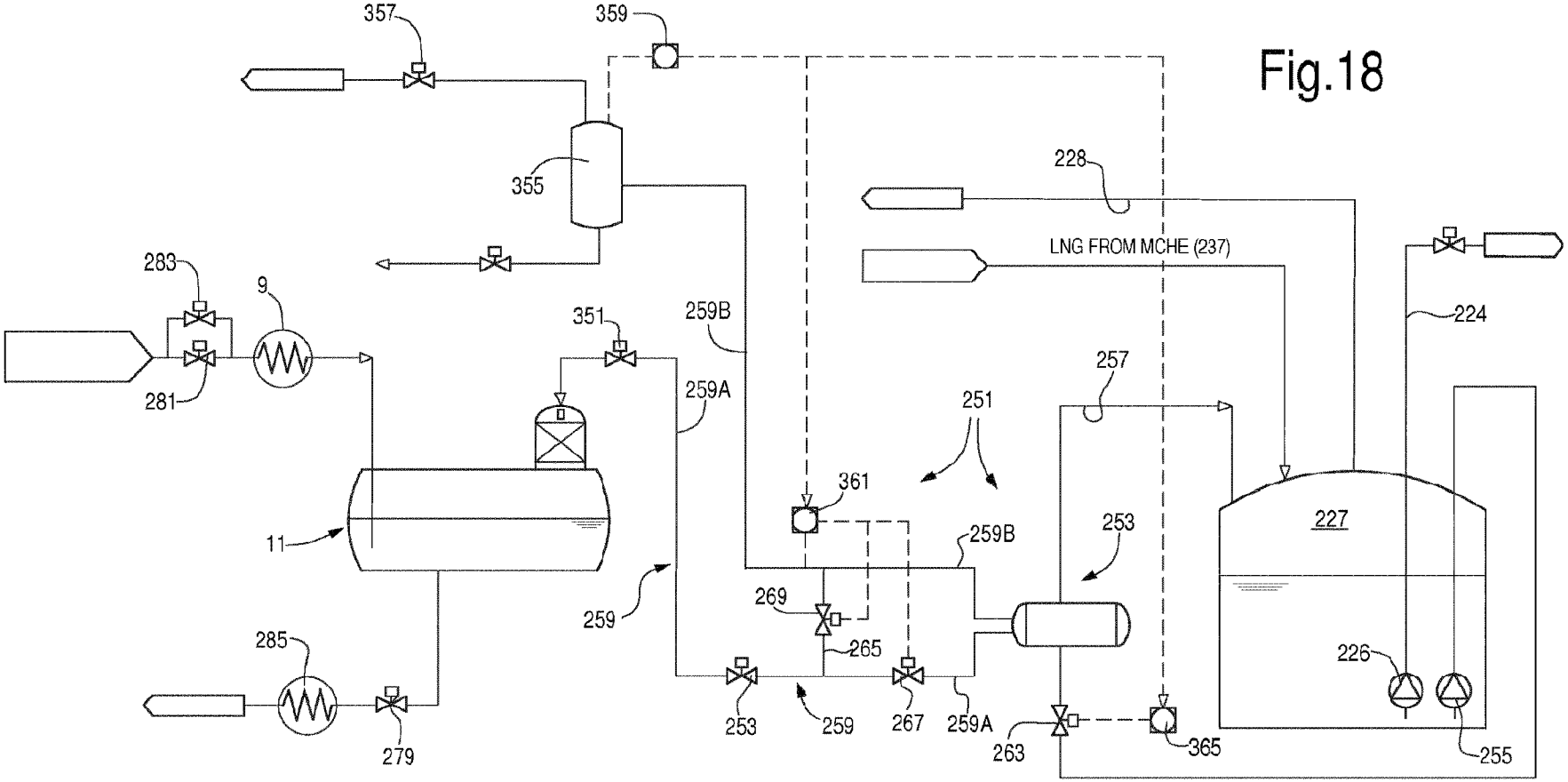
FIG. 18 illustrates a further embodiment of a liquefied gas storage tank of the arrangement of FIG. 13, in combination with a working fluid collection vessel and relevant chilling arrangement.

Instead of adjusting the temperature set-point of temperature controller 361, the pressure signal from pressure controller 359 can be used to adjust the fluid flow-rate from the fluid collection vessel 11 and/or the LNG flow-rate from storage unit 227. This latter option is shown in the embodiment of FIG. 18. The same reference numbers used in FIG. 17 designate the same or similar elements, parts and components, which will not be described again. In FIG. 18 the pressure controller 359 is coupled to temperature controller 361 and to an LNG flow-rate controller 365, which controls the LNG flow rate through heat exchanger 253 acting upon valve 263.

Figure 19:
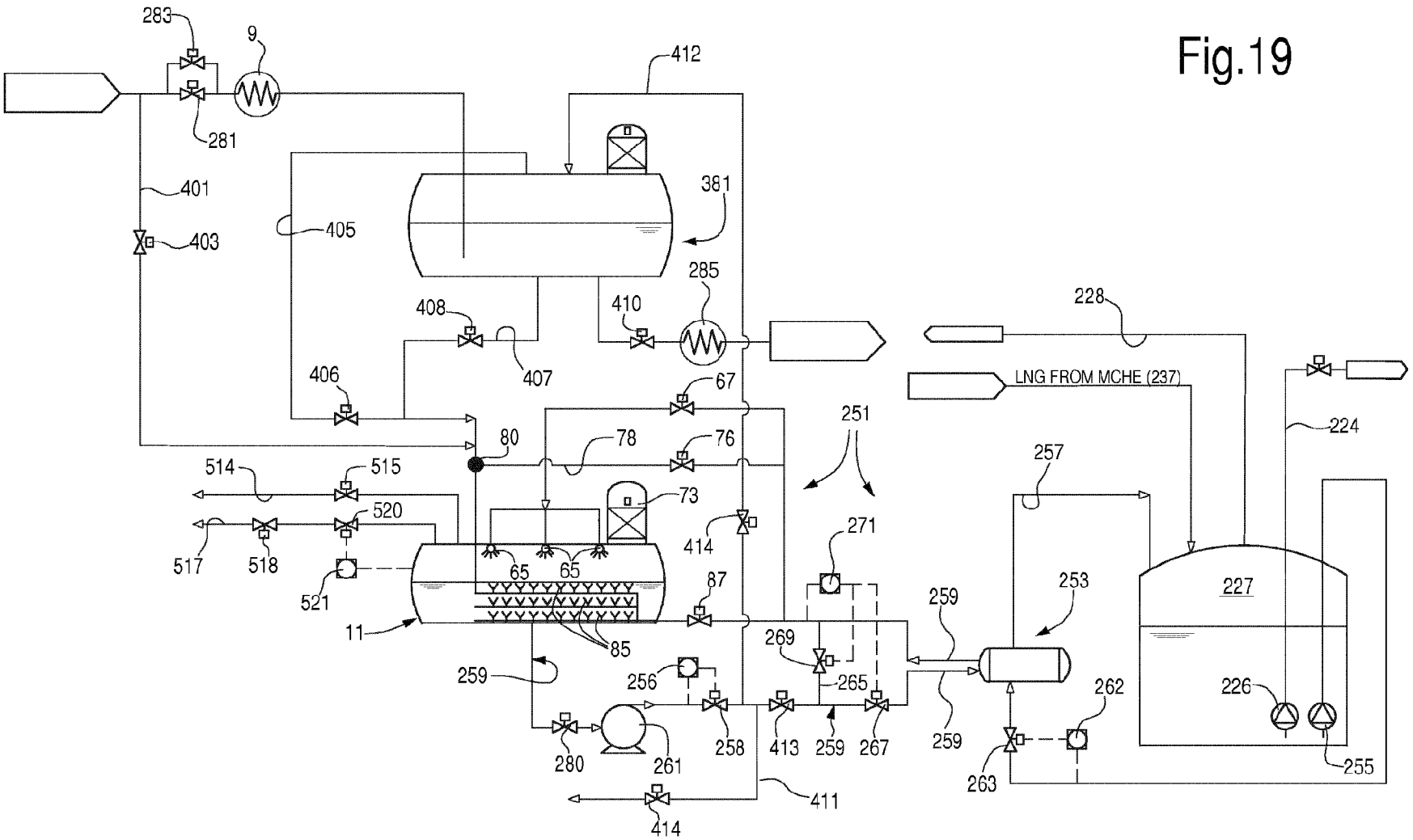
FIG. 19 illustrates a further embodiment of a liquefied gas storage tank of the arrangement of FIG. 13, in combination with a working fluid collection vessel and relevant chilling arrangement.

In some existing LNG plants, the refrigerant collection vessel may be very large, e.g. may be designed to contain up to 60-70 tons of refrigerant working fluid, for instance. In some circumstances, it may not be convenient to place such large vessel in a loop arrangement 259 with the heat exchanger 253. This is particularly the case if a large LNG facility is to be upgraded with a chilling arrangement 251 as described herein. In some circumstance, it could be more convenient to have an additional, smaller fluid collection vessel 11 for chilling and de-pressurization purposes, added to the larger refrigerant working fluid collection vessel of the system. An arrangement of this kind is shown in FIG. 19. The same reference numbers as used in FIG. 14 designate the same or corresponding elements, parts or components, which will not be described again.

In the embodiment of FIG. 19 the fluid collection vessel 11 is fluidly coupled to a larger refrigerant working fluid container 381, e.g. containing from 3 to 10 times more fluid than fluid collection vessel 11. The chilling arrangement 251 in this case acts upon the smaller amount of fluid contained in the fluid collection vessel 11. The fluid collection vessel 11 operates as a start-up accumulator.

The fluid collection vessel 11 can be fluidly coupled to the closed refrigeration circuit 3 with an inlet duct 401, having an inlet end between the delivery side 7D of compressor 7 and fluid condensing arrangement 9 and terminating in the fluid collection vessel l l A valve 403 can selectively open and close the inlet duct 401.

The fluid collection vessel 11 can further be fluidly coupled to the refrigerant working fluid container 381 through a vapor line 405 and a liquid line 407, which may each include a respective valve 406 and 408. The delivery side of circulation pump 261 can be fluidly coupled selectively to the heat exchanger 253 of the chilling arrangement 251, as described in connection with FIG. 14, or to the compressor 7. For this purpose, a return line 411 fluidly connects the delivery side of pump 261 to one of the side streams of compressor 7, for instance. A valve 414 can be provided on return line 411 and a valve 413 can be provided in loop 259. The delivery side of the circulation pump 261 can be further fluidly coupled to the working fluid container 381 through a line 412. A valve 414 can be provided on line 412 for selectively opening and closing the fluid path from the delivery side of the circulation pump 261 to the working fluid container 381.

The fluid collection vessel 11 can further be fluidly coupled to the low pressure (LP) or very-low pressure (LLP) main header of compressor 7 through a line 514 and a valve 515 to maintain the vessel 11 at the same pressure as the pressure of the corresponding side stream (LP or LLP) of the compressor 7. Moreover, the fluid collection vessel 11 can further be fluidly coupled to the low-pressure (LP) or medium pressure (MP) chiller 215A, 215B of compressor 7 on the liquid outlet side through a line 517, a valve 518 and level control valve 520. With such arrangement, an amount of liquid inside the fluid collection vessel 11 will be maintained for cooling in the heat exchanger 253, to start the cooling-down operation. The above described connections ensure that the fluid collection vessel 11 is maintained at the same pressure and temperature of the respective LLP or LP chillers 215A, 215B (e.g. 1.1 barA and −40° C.).

Operation of the system of FIG. 19 can be as follows. When the closed refrigeration circuit 3 is operating, valves 281, 515 and 518, valves 403 and 413 and/or 414 are closed and valve 517 is activated to control the liquid level in the fluid collection vessel 11. Condensed refrigerant working fluid from fluid condensing arrangement 9 is collected in the refrigerant working fluid container 381 and delivered therefrom through sub-cooler 285 to the expansion section 217. A valve 410 arranged between container 381 and sub-cooler 285 can be provided and is maintained in open condition during this operation phase. Moreover, the circulation pump 261 may be in operation and the flow rate can be maintained by the flow-rate controller at a set low value to keep the heat exchanger 253 at low temperature.

Upon tripping of compressor 7 valves 281, 283, 515 and 518 are closed, the level controller 521 is switched to manual and valve 520 is closed. The pressure inside the closed refrigeration circuit 3 can increase and become the same in the whole circuit. Before re-starting the compressor 7, pressure inside the closed refrigeration circuit 3 shall be reduced. The fluid collection vessel 11 is used as a start-up accumulator for this purpose, while larger refrigerant working fluid container 381 is temporarily in-operative. Depressurization of closed refrigeration circuit 3 can start by opening valve 403 while valve 413 is maintained closed. While valve 403 opens, the pressure inside the fluid collection vessel 11 may increase, since pressure equalization with compressor 7 is carried out. The cryogenic pump 255 is switched on and the flowrate set-points of the flow controller 256 and 262 respectively are ramped slowly to a specific value. Similarly, the set-point of the temperature controller 271 is ramped to a lower value (e.g. −155° C.) acting on the valves 267 and 269.

The pressure inside fluid collection vessel 11 can be gradually reduced by circulating the refrigerant working fluid contained therein through heat exchanger 253. Once a specific pressure inside fluid collection vessel 11 is reached, the set-point of temperature controller 271 is ramped to a higher value (e.g. −40° C.) based on the final pressure to be achieved in the fluid collection vessel 11. By removing heat through heat exchanger 253 the flow of gaseous working fluid entering fluid collection vessel 11 through line 401 is condensed. Consequently, the pressure inside the closed refrigeration circuit 3 gradually drops until a start-up pressure is achieved therein, e.g. around 1-1.2 barA. Once the start-up pressure is achieved, valve 403 is kept open, cryogenic pump 255 is shutdown, flow controllers 256 and 262 are switched to manual mode and valves 258, 263, 67 and 87 are closed. Pump 261 will work through minimum flow line 273 (see FIG. 16). Compressor 7 can be started up. During start-up transient or during the loading phase, liquefied refrigerant working fluid from fluid collection vessel 11 can be circulated by pump 261 towards the suction side of compressor 7, by opining valve 413. If, as shown in FIG. 13, the refrigerant working fluid is expanded at several pressure levels, during the start-up phase described herein, the refrigerant working fluid flowing through line 411 and valve 413 can be delivered towards the lowest pressure side stream of compressor 7. Thus, the refrigerant working fluid which has been condensed and collected in fluid collection vessel 11 during the de-pressurization phase can be gradually re-introduced in the closed refrigeration circuit 3. The pressure at the delivery side of compressor 7 gradually increases and, upon reaching the rated delivery pressure, valves 401 and 413 can be closed, while valves 281, 283 and 410 can be opened. The closed refrigeration circuit 3 is now fully operative again.

Alternatively, during the start-up transient and/or during the loading phase the liquefied refrigerant working fluid from fluid collection vessel 11 can be gradually re-introduced into the larger refrigerant working fluid container 381 by opening valve 414.

If the closed refrigeration circuit 3 remains inoperative for a longer period of time, the pressure inside the refrigerant working fluid container 381 may increase above a threshold value. If this is the case, pressure therein can be gradually reduced using the chilling arrangement 251 and maintaining the refrigerant working fluid container 381 fluidly coupled through line 405 and valve 406, such that refrigerant working fluid in vapor phase can flow from the refrigerant working fluid container 381 in the fluid collection vessel 11.

Some of the features described above can be embodied also in a system according to FIG. 19. By way of example, FIG. 19 shows a line 78, a quench valve or spray nozzle 80 and an isolation valve 76, which may have similar functions as described above in connection with some of the previously described embodiments.

Similarly, a bypass line 68 and shutoff valve 71 as described above can also be provided in other embodiments, such as the one depicted in FIG. 19.

Figure 20:
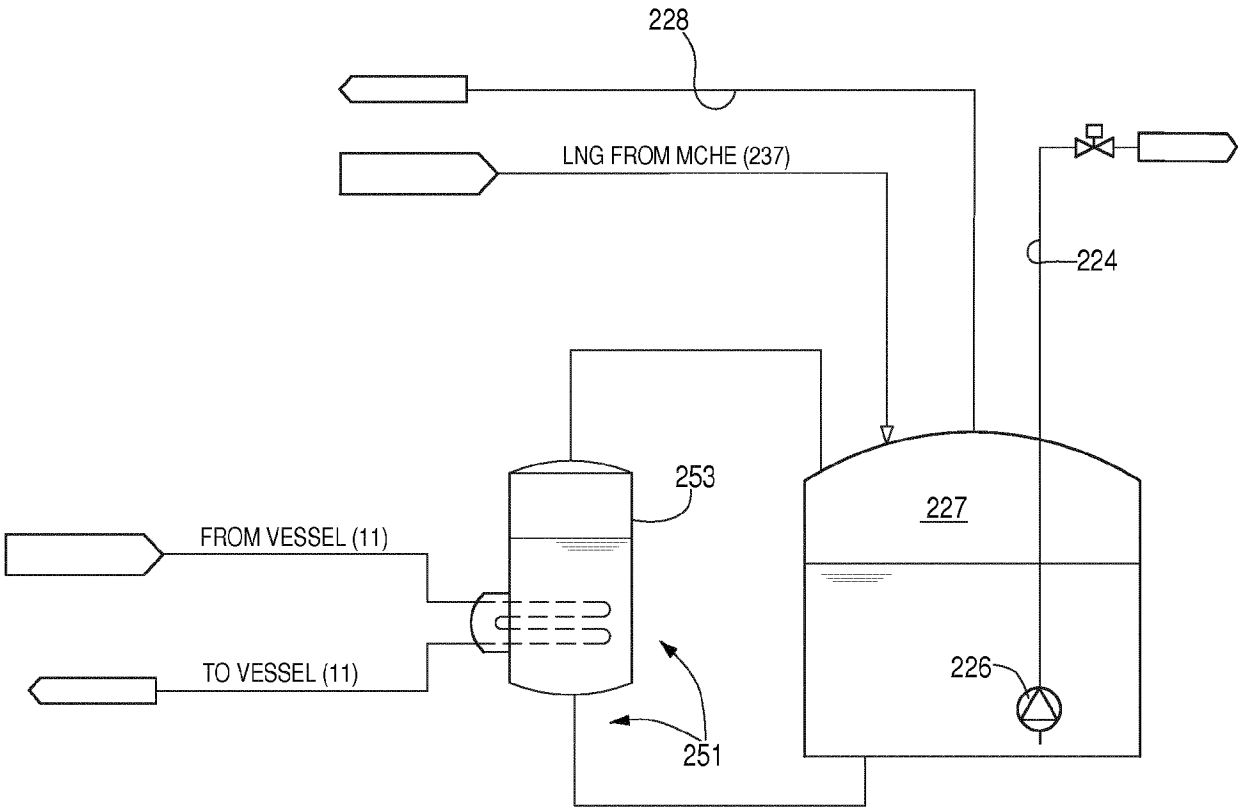
FIGS. 20 and 21 illustrate modified configurations of the chilling arrangement of FIG. 19.

FIG. 20 illustrates a further embodiment of the chilling arrangement 251. In FIG. 20 only the LNG storage unit 227 and the heat exchanger 253 are shown. The hot side of the heat exchanger 253 can be fluidly coupled to the remaining part of the circuit according to any one of the arrangements described above.

In FIG. 20 circulation of the fluid in the cold side of the heat exchanger 253 is achieved by natural circulation, based on the communicating vessels principle, rather than by using a cryogenic pump. A correct level of liquefied natural gas is maintained in heat exchanger 253, to cool the fluid circulating in the hot side thereof.

Figure 21:
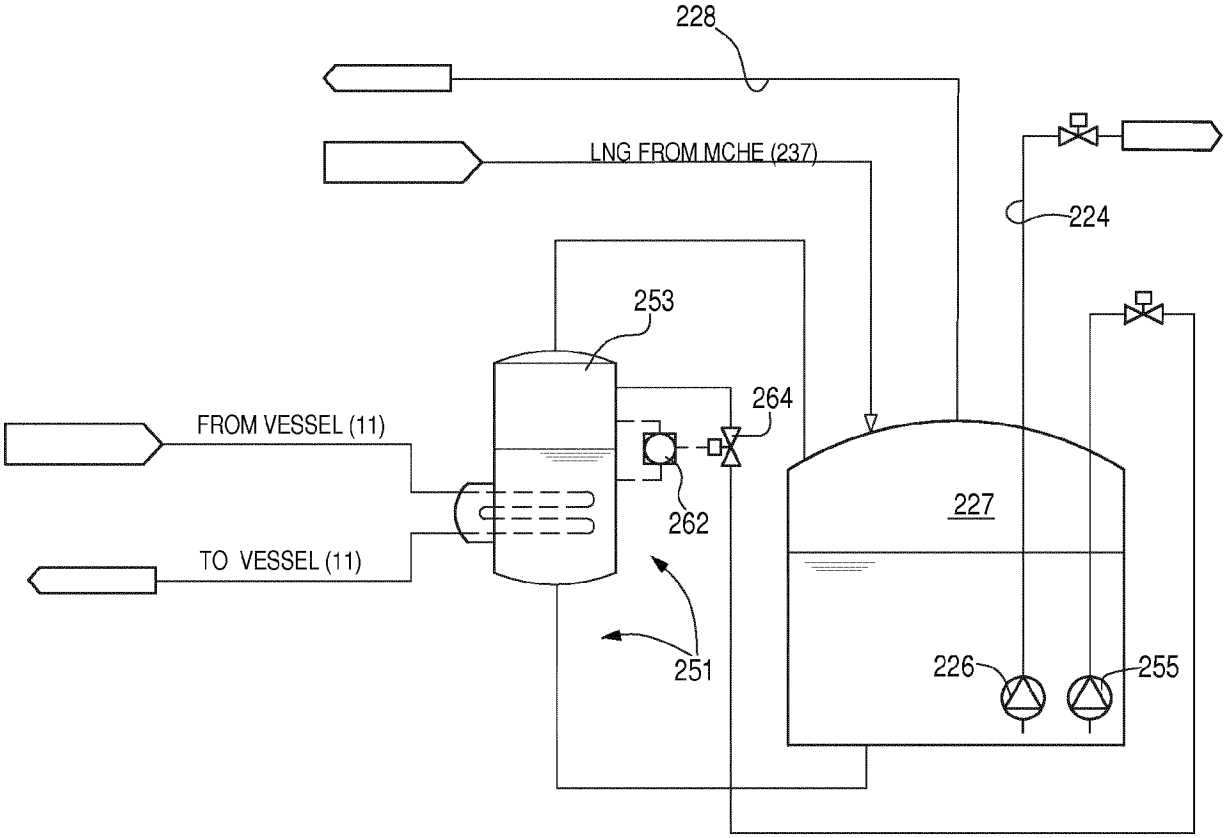

A combined embodiment, with a forced circulation using a cryogenic pump, in combination with an arrangement according to the communicating vessels principle is show in FIG. 21. The same reference numbers designate the same or corresponding parts as described in connection with the previous embodiments. In FIG. 21 a level controller 262 is provided to control the level of liquefied natural gas in the cold side of the heat exchanger 253. The controller 262 can act upon a valve 264 to selectively open and close the valve and thus restore a correct liquid level through activation of the cryogenic pump 255.

Figure 22:
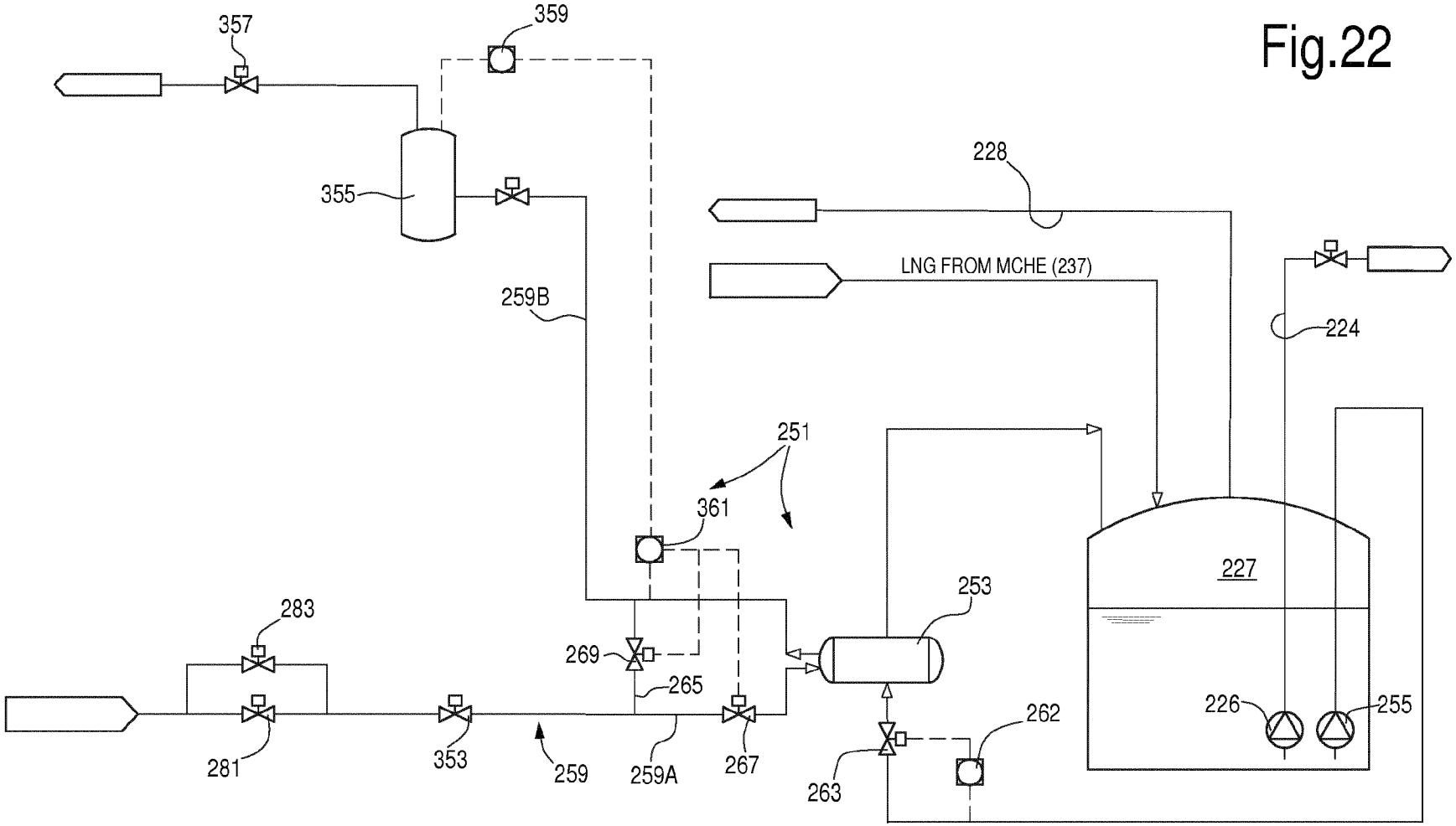
FIGS. 22 and 23 illustrate further embodiments of a liquefied gas storage tank of the arrangement of FIG. 13, in combination with a working fluid collection vessel and relevant chilling arrangement.
Figure 23:
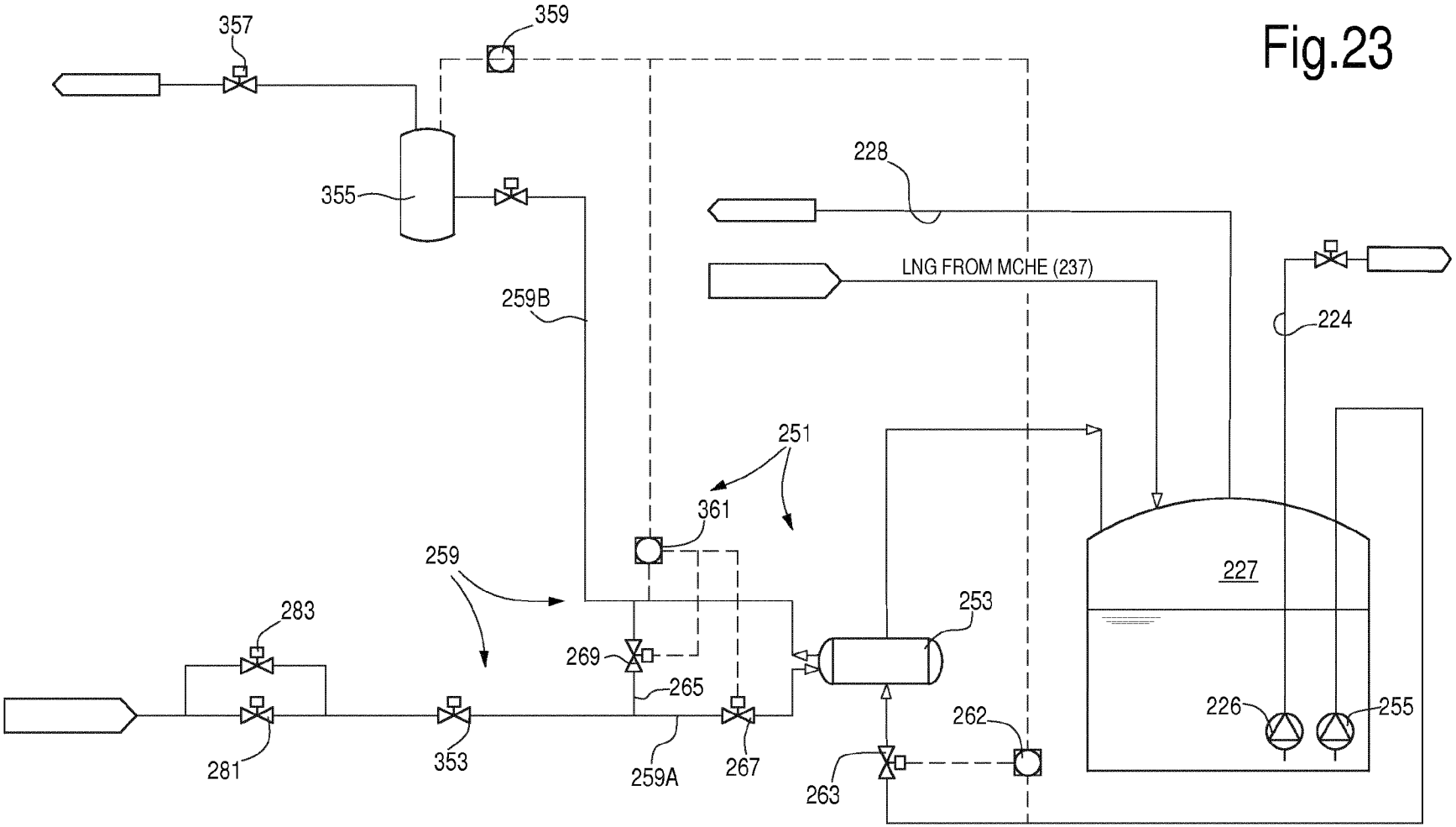

FIGS. 22 and 23 illustrate embodiments similar to FIGS. 17 and 18, where the fluid collection vessel 11 is omitted. The same reference numbers designate the same or equivalent parts, elements or components as already shown in FIGS. 17 and 18 and described above. The chilling arrangement 251 in FIGS. 22 and 23 can be fluidly coupled to a delivery side of the compressor 7 of the closed refrigeration circuit 3. When depressurization of the closed refrigeration circuit 3 is required, valve 283 and subsequently valve 281 are opened such that pressurized, hot refrigerant working fluid flows through the loop 259 and more specifically through an inlet section 259A and is chilled in heat exchanger 253 by exchanging heat against the liquefied natural gas from the storage unit 227. Chilled and liquefied refrigerant working fluid is collected in vessel 355. Therefrom the chilled and liquefied refrigerant working fluid is returned in the closed refrigeration circuit 3. As described in connection with FIG. 17, a pressure controller 359 adjusts the temperature set-point of a temperature controller 361, such that the required pressure of the bi-phasic working fluid (liquid/gas, i.e. liquid/vapor working fluid) is maintained in vessel 355. The temperature controller adjusts the flow-rates through the heat exchanger 253 and through the by-pass line 265.

The embodiment of FIG. 23 is similar to the embodiment of FIG. 22; the pressure controller 359 co-acts with flow-rate controller 365 and with temperature controller 361.

In the embodiments of FIGS. 22 and 23 the chilling arrangement is thus functionally coupled to the fluid collection vessel 355 and removes heat from the working fluid while the latter flows through a delivery duct, formed by loop 259, while it is being collected in the fluid collection vessel 355, instead of removing heat from liquid previously collected in the fluid collection vessel. The principle of operation is however the same as in the previously described embodiments: the thermodynamic system, whereof the fluid collection vessel forms part, is de-pressurized when needed by removing heat from the working fluid contained therein, such that gaseous working fluid is condensed into liquid working fluid.

Figure 24:
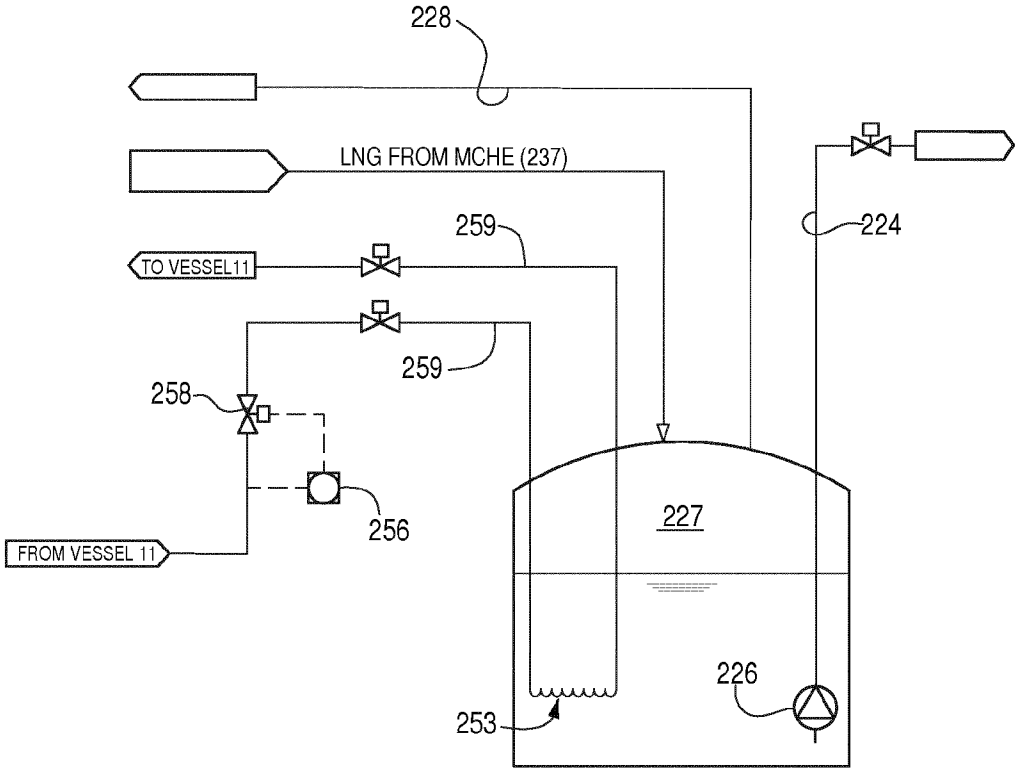
FIG. 24 illustrates a modified embodiment of the chilling arrangement.

FIG. 24 illustrates a further embodiment of the chilling arrangement 251. In FIG. 24 only the heat exchanger 253 and the storage unit 227 are shown, in combination with a portion of the loop 259, which circulates the working fluid through the heat exchanger 253. A flow rate controller 256 functionally coupled to a flow ratecontrol valve 258 are arranged in loop 259. According to the embodiment of FIG. 24 the heat exchanger 253 is arranged directly in the storage tank or unit 227 and can be submerged in the liquefied process fluid (e.g. liquefied natural gas) contained therein.

While the invention has been described in terms of various specific embodiments, it will be apparent to those of ordinary skill in the art that many modifications, changes, and omissions are possible without departing form the spirt and scope of the appended claims. In addition, unless specified otherwise herein, the order or sequence of any process or method steps may be varied or re-sequenced according to alternative embodiments.

The invention claimed is:

1. A thermodynamic system comprising:

at least one working fluid collection vessel adapted to contain a liquid phase and a gaseous phase of a working fluid in thermodynamic equilibrium; and a closed circuit, functionally coupled to the at least one working fluid collection vessel and containing the working fluid;

a chilling arrangement functionally coupled to the at least one working fluid collection vessel and adapted to remove heat from the working fluid collected in the at least one working fluid collection vessel to thereby reduce a settle-out-pressure in the closed circuit, when no working fluid is circulating in the closed circuit.

2. The thermodynamic system of claim 1, wherein said closed circuit further comprises a high-pressure section and a low-pressure section; and wherein a pressure boosting arrangement is provided in said closed circuit, adapted to circulate the working fluid therein.

3. The thermodynamic system of claim 1, wherein the closed circuit further comprises: a heat removal and fluid condensing arrangement, adapted to receive working fluid in a gaseous phase and to at least partly condense said working fluid into liquefied working fluid, wherein the at least one working fluid collection vessel is adapted to receive condensed fluid from the heat removal and fluid condensing arrangement.

4. The thermodynamic system of claim 1, wherein the closed circuit further comprises a suction drum arranged upstream of at least one compressor, adapted to contain bi-phasic working fluid and to deliver gaseous working fluid to said compressor.

5. The thermodynamic system of claim 1, wherein the at least one working fluid collection vessel further comprises a suction drum.

6. The thermodynamic system of claim 1, wherein the chilling arrangement comprises a first heat removal device comprised of a heat exchanger, in which a refrigerant flows in heat exchange relationship with the liquefied working fluid.

7. The thermodynamic system of claim 6, wherein said first heat removal device comprises at least one of: nozzles or bubblers submerged in the liquefied working fluid contained in the at least one working fluid collection vessel; spraying devices arranged in the at least one working fluid collection vessel, adapted to spray chilled working fluid therein.

8. The thermodynamic system of claim 1, wherein the chilling arrangement comprises at least one circulation pump adapted to circulate working fluid drawn from the at least one working fluid collection vessel and returned thereto.

9. The thermodynamic system of claim 8, wherein the circulation pump is adapted to draw liquefied working fluid from the at least one working fluid collection vessel and circulate the liquefied working fluid through a heat exchanger in heat exchange relationship with a refrigerant.

10. The thermodynamic system of claim 8, wherein the circulation pump is adapted to deliver pressurized liquefied working fluid to one of: nozzles or bubblers submerged in the liquefied working fluid contained in the at least one working fluid collection vessel; quench valves arranged in the at least one working fluid collection vessel above the level of liquefied working fluid; a fluid delivery duct configured to deliver working fluid to the at least one working fluid collection vessel; a combination thereof.

11. The thermodynamic system of claim 8, wherein the circulation pump is adapted to draw liquefied working fluid from a liquid/gas separator, fluidly coupled to the at least one working fluid collection vessel, and to circulate the liquefied working fluid through a heat exchanger, in heat exchange relationship with a refrigerant, and to further deliver chilled liquefied working fluid back to the at least one working fluid collection vessel.

12. The thermodynamic system of claim 1, comprising a circulation pump adapted to circulate working fluid from the at least one working fluid collection vessel through a heat exchanger of said fluid chilling arrangement and back to the at least one working fluid collection vessel to remove heat from working fluid contained in the at least one working fluid collection vessel.

13. The thermodynamic system of claim 1, wherein the closed circuit further comprises:

a high-pressure section;

a low-pressure section;

a compressor system between the low-pressure section and the high-pressure section;

an expansion section adapted to expand the working fluid from the high-pressure section towards the low-pressure section;

a heat exchange arrangement between the expansion section and the compressor system, adapted to circulate the expanded working fluid in heat exchange relationship with a process fluid and remove heat therefrom;

a liquefied process fluid storage unit, adapted to collect liquefied process fluid therein.

14. The thermodynamic system of claim 13, wherein the chilling arrangement further comprises a heat exchanger having a hot side and a cold side, wherein the hot side is adapted to circulate the working fluid in heat exchange relationship with one of: a refrigerant in the cold side of the heat exchanger and liquefied process fluid in the cold side of the heat exchanger.

15. A method for reducing a fluid settle-out pressure in a closed circuit of a thermodynamic system, wherein the closed circuit contains a working fluid, and the thermodynamic system further includes at least one working fluid collection vessel, adapted to contain liquefied working fluid and gaseous working fluid in thermodynamic equilibrium; the method comprising the steps of:

removing heat from the working fluid contained in the at least one working fluid collection vessel, when no fluid is circulating in the closed circuit; and condensing gaseous working fluid into liquefied working fluid thus reducing said fluid settle-out pressure in the thermodynamic system.

16. The method of claim 15, wherein the step of removing heat from the working fluid comprises the steps of:

circulating a refrigerant in heat exchange relationship with liquefied working fluid from the at least one working fluid collection vessel to remove heat thereby; and drawing liquefied working fluid from the at least one working fluid collection vessel and returning chilled liquefied working fluid back to the at least one working fluid collection vessel.

17. The method of claim 15, wherein the step of removing heat from the working fluid comprises the steps of:

drawing gaseous working fluid from the at least one working fluid collection vessel;

cooling and at least partly condensing said gaseous working fluid by heat exchange with a refrigerant; and returning condensed gaseous working fluid back to the working fluid collection vessel.

18. The method of claim 17, wherein the closed circuit includes: a high-pressure section; a low-pressure section; a compressor system between the low-pressure section and the high-pressure section; an expansion section adapted to expand the working fluid from the high-pressure section towards the low-pressure section; the method further comprising the following steps:

chilling a process fluid by heat exchange with the working fluid in a heat exchange arrangement between the expansion section and the compressor system, wherein expanded working fluid circulates in heat exchange relationship with said process fluid and remove heat therefrom;

collecting liquefied process fluid in a liquefied process fluid storage unit.

19. The method of claim 18, further comprising:

circulating the working fluid in heat exchange relationship with said liquefied process fluid.

* * * * *